US011295674B2

(12) United States Patent
Yang et al.

(10) Patent No.: US 11,295,674 B2
(45) Date of Patent: Apr. 5, 2022

(54) IMAGE COMPENSATION CIRCUIT AND RELATED COMPENSATION METHOD

(71) Applicant: NOVATEK Microelectronics Corp., Hsin-Chu (TW)

(72) Inventors: Jun-Yu Yang, Hsinchu (TW); Wei-Jhe Ma, Taichung (TW); Yung-Cheng Tsai, Hsinchu (TW); Feng-Ting Pai, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 17/199,468

(22) Filed: Mar. 12, 2021

(65) Prior Publication Data

US 2021/0304677 A1 Sep. 30, 2021

Related U.S. Application Data

(60) Provisional application No. 63/000,505, filed on Mar. 27, 2020.

(51) Int. Cl.
*G09G 3/32* (2016.01)
*G09G 3/3258* (2016.01)

(52) U.S. Cl.
CPC ... *G09G 3/3258* (2013.01); *G09G 2320/0233* (2013.01); *G09G 2320/0276* (2013.01); *G09G 2360/16* (2013.01)

(58) Field of Classification Search
CPC ..... G09G 3/3258; G09G 2320/0233; G09G 2320/0276; G09G 2360/16; G09G 3/3291;

(Continued)

(56) References Cited

U.S. PATENT DOCUMENTS

2015/0123955 A1* 5/2015 Bi ..... G09G 3/3275 345/207
2016/0180763 A1* 6/2016 Park ..... G09G 3/2003 345/691

(Continued)

FOREIGN PATENT DOCUMENTS

CN 104867455 B 5/2017
CN 106297665 B 12/2018

OTHER PUBLICATIONS

Ma, the specification, including the claims, and drawings in the U.S. Appl. No. 16/262,934, filed Jan. 31, 2019.

*Primary Examiner* — Jose R Soto Lopez
(74) *Attorney, Agent, or Firm* — Winston Hsu

(57) ABSTRACT

The present invention provides an image compensation circuit generating output image data to drive a display panel having pixels. The image compensation circuit includes first/second control circuits and first/second compensation circuits. The first control circuit may receive input image data for the pixels and generate a plurality of first compensation values corresponding to compensation for voltage drop on the display panel according to the input image data. The first compensation circuit may compensate the input image data for the pixels with the first compensation values. The second control circuit may receive the first compensation values from the first control circuit and generate a plurality of second compensation values corresponding to compensation for channel length modulation (CLM) effect of the pixels according to the first compensation values. The second compensation circuit may compensate the input image data for the pixels with the second compensation values, to generate the output image data.

16 Claims, 18 Drawing Sheets

(58) Field of Classification Search
CPC ..... G09G 2310/027; G09G 2320/0242; G09G 3/2003; G09G 3/3233; G09G 2320/0223
See application file for complete search history.

(56) References Cited

U.S. PATENT DOCUMENTS

| | | | | |
|---|---|---|---|---|
| 2016/0189628 | A1* | 6/2016 | Choi | G09G 3/3233 345/690 |
| 2017/0032743 | A1 | 2/2017 | Lee | |
| 2019/0005883 | A1* | 1/2019 | Kim | G09G 3/3233 |
| 2019/0340980 | A1* | 11/2019 | Yum | G09G 3/3233 |
| 2020/0051508 | A1* | 2/2020 | Tan | G09G 3/3233 |
| 2020/0111423 | A1* | 4/2020 | Orio | G09G 3/3225 |
| 2020/0143750 | A1* | 5/2020 | Gao | G09G 3/3291 |
| 2020/0279519 | A1* | 9/2020 | Orio | G09G 3/2011 |
| 2021/0193034 | A1* | 6/2021 | Li | G09G 3/3233 |

* cited by examiner $$I_{OLED} = K\,[\,ELVDD - D1 + Vt\,]^2$$
$$Lum = \beta \times I_{OLED}$$

- IR drop ΔV + compensation $$I_D = K((V_S - \Delta V) - (V_G - \Delta V) - Vt)^2 \cdot (1 + \lambda \cdot V_{SD} - \lambda \cdot \Delta V)$$

$$I_{ideal} = K(V_S - V_G - Vt)^2$$

- IR drop ΔV + compensation of ΔV and δ

$$I_D = K((V_S - \Delta V) - (V_G - \Delta V - \delta) - Vt)^2 \cdot (1 + \lambda \cdot V_{SD} - \lambda \cdot \Delta V)$$

- $$\delta = (V_S - V_G - Vt) \cdot \left( \sqrt{\frac{1}{1 + \lambda \cdot V_{SD} - \lambda \cdot \Delta V}} - 1 \right)$$

IMAGE COMPENSATION CIRCUIT AND RELATED COMPENSATION METHOD

CROSS REFERENCE TO RELATED APPLICATIONS

This application claims the benefit of U.S. Provisional Application No. 63/000,505, filed on Mar. 27, 2020, the contents of which are incorporated herein by reference.

BACKGROUND OF THE INVENTION

1. Field of the Invention

The present invention relates to an image compensation circuit and a related compensation method, and more particularly, to an image compensation circuit and a related compensation method for compensating an organic light-emitting diode (OLED) panel.

2. Description of the Prior Art

Please refer to FIG. 1, which is a schematic diagram of a pixel 10 of an organic light-emitting diode (OLED) panel such as an active matrix OLED (AMOLED) panel. The pixel 10 is composed of two thin-film transistors (TFTs) T1 and T2, two capacitors C1 and C2, and an OLED O1. The pixel 10 may be operated by receiving power supply voltages ELVDD and ELVSS. A display data D1 is inputted through the TFT T1 with control of a scan signal S1. Based on the display data D1, a cross voltage may be generated between the capacitor C1 (i.e., between the gate terminal and the source terminal of the TFT T2); hence, the current $I_{OLED}$ through the OLED O1 may be generated accordingly based on the metal-oxide semiconductor field-effect transistor (MOSFET) formula as shown in FIG. 1. The luminance (Lum) of the OLED O1 will be obtained by multiplying the current $I_{OLED}$ by a luminance parameter β.

In general, the OLED panel usually suffers from an IR drop problem, which is caused by different impedance between pixels and the power source of the OLED panel. A compensation scheme may be applied to compensate for the IR drop to improve the consistency of the luminance of the OLED panel. However, the compensation scheme for IR drop may usually be performed based on the simplified MOSFET formula as shown in FIG. 1, where the channel length modulation (CLM) effect of the MOSFET is not in consideration. In the pixel 10, the CLM effect may usually increase the drain current of the TFT T2 with an increasing drain-to-source voltage, where the drain current may be served as the current $I_{OLED}$ to drive the OLED O1. Since the IR drop of the panel may usually influence the power supply voltage ELVDD and thereby influence the source voltage of the TFT T2, the current $I_{OLED}$ flowing through the OLED O1 may also be influenced. Thus, there is a need to provide a novel compensation scheme for the OLED panel, which is capable of compensating for both the IR drop and CLM effect.

SUMMARY OF THE INVENTION

It is therefore an objective of the present invention to provide an image compensation circuit and a related compensation method for compensating an organic light-emitting diode (OLED) panel, in order to solve the abovementioned problems.

An embodiment of the present invention discloses an image compensation circuit that generates output image data to drive a display panel, where the display panel comprises a plurality of pixels. The image compensation circuit comprises a first control circuit, a first compensation circuit, a second control circuit and a second compensation circuit. The first control circuit is used to receive input image data for the pixels and generate a plurality of first compensation values for the pixels according to the input image data. The first compensation circuit, coupled to the first control circuit, is used to compensate the input image data for the pixels with the first compensation values. The second control circuit, coupled to the first control circuit, is used to receive the first compensation values from the first control circuit and generate a plurality of second compensation values for the pixels according to the first compensation values. The second compensation circuit, coupled to the second control circuit, is used to compensate the input image data for the pixels with the second compensation values, to generate the output image data. Wherein, the first compensation values correspond to a compensation for a voltage drop on the display panel, and the second compensation values correspond to a compensation for a channel length modulation (CLM) effect of the pixels.

Another embodiment of the present invention discloses a compensation method for an image compensation circuit that generates output image data to drive a display panel having a plurality of pixels. The compensation method comprises steps of: receiving input image data for the pixels; generating a plurality of first compensation values for the pixels according to the input image data; generating a plurality of second compensation values for the pixels according to the first compensation values; and compensating the input image data for the pixels with the first compensation values and the second compensation values, to generate the output image data. Wherein, the first compensation values correspond to a compensation for a voltage drop on the display panel, and the second compensation values correspond to a compensation for a CLM effect of the pixels.

These and other objectives of the present invention will no doubt become obvious to those of ordinary skill in the art after reading the following detailed description of the preferred embodiment that is illustrated in the various figures and drawings.

DETAILED DESCRIPTION

Figure 2A:
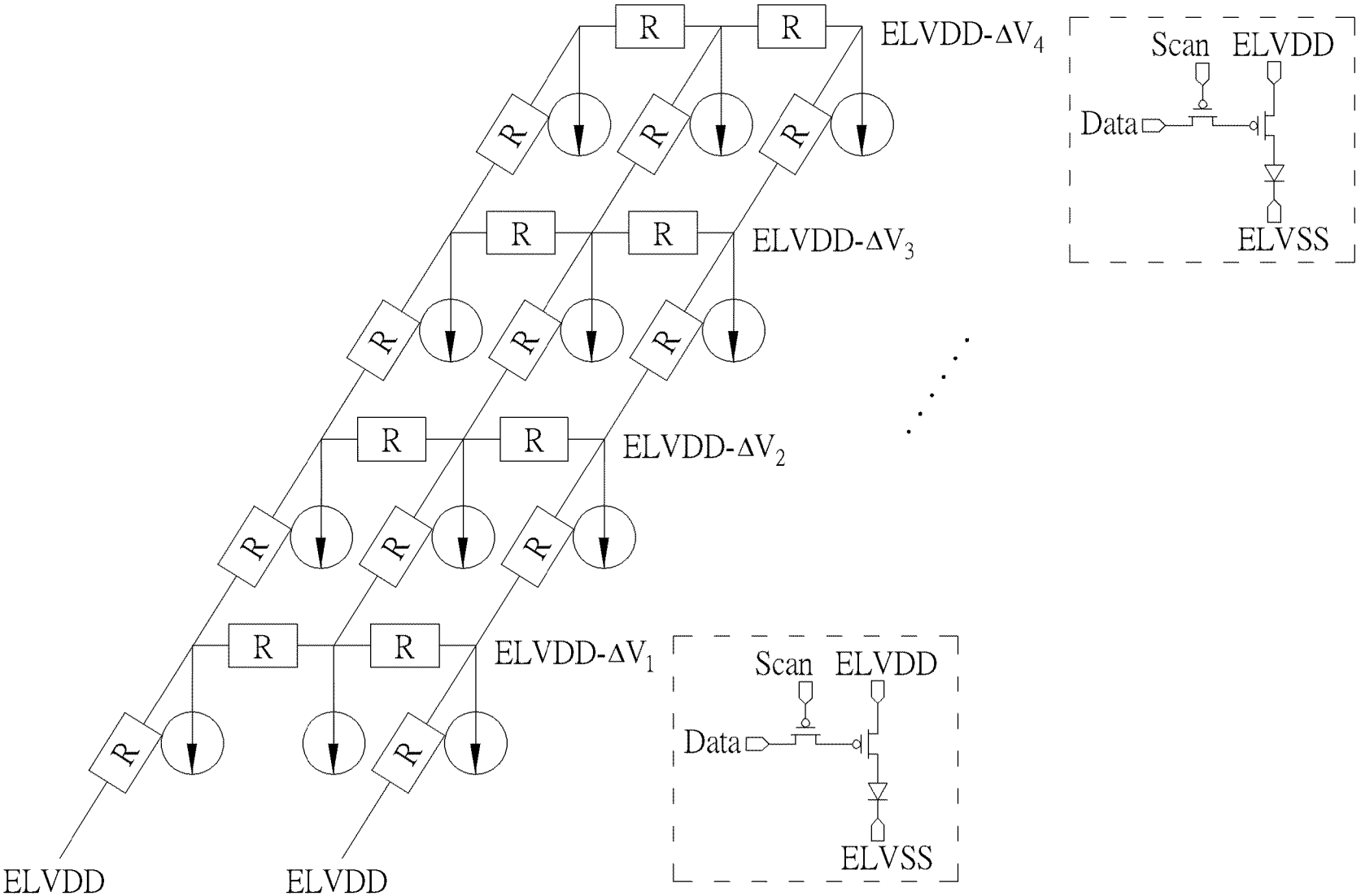
FIGS. 2A and 2B are schematic diagrams of the IR drop phenomenon on a display panel.
Figure 2B:
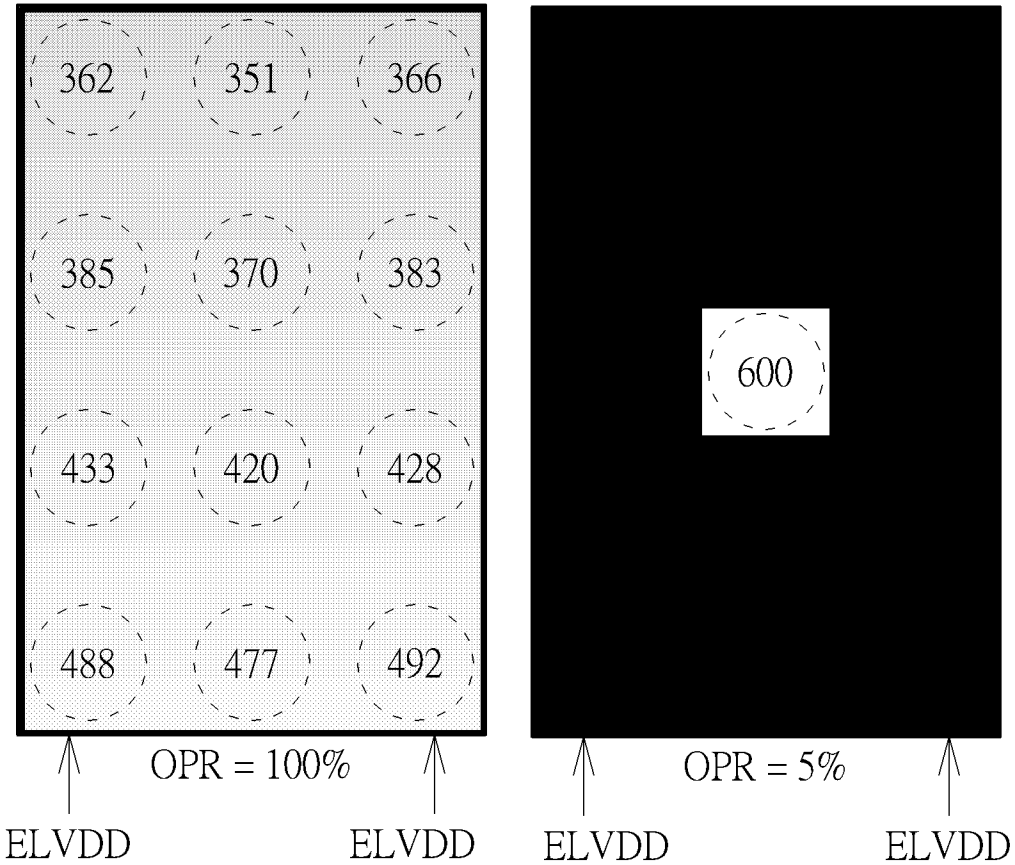

FIGS. 2A and 2B illustrate the IR drop phenomenon. On the display panel driven by currents, due to the change of display content, IR drop with different degrees may appear on the power supply traces. Therefore, under the same display content, different display positions may show different brightness due to their distance from the power source, resulting in poor consistency of luminance or chromaticity of the display panel, which may be an organic light-emitting diode (OLED) panel in which the luminance is generated from the OLEDs in the pixels.

For example, as shown in FIG. 2A, the power lines between each pixel on the panel have parasitic resistors (denoted by R). The power supply, located at the bottom of the panel, may supply the voltage ELVDD to the pixels on the entire panel. Although the voltage outputted by the power supply may equal ELVDD, a voltage drop $\Delta V$ may appear on every resistor R, and the voltage drop is larger with a distance farther away from the power supply. In addition, because $\Delta V = I \times R$, the greater the passing current, the larger the voltage drop. Therefore, if more pixels are lit on, the generated current is also larger, and the IR drop phenomenon will be more evident.

As shown in FIG. 2B, if a full white image (i.e., the on pixel ratio (OPR) equals 100%) is displayed on the panel, although all pixels are white image data, lower luminance is measured at the position farther from the power source. For example, the values shown in the circles stand for the luminance measured at the position, where original luminance corresponding to the power supply voltage delivered from the power source may equal 600. As shown in FIG. 2B, the pixels at the upper parts of the panel show lower luminance (e.g., 362, 351, 366) since these pixels are farther from the power source at the bottom place; and the pixels at the lower parts of the panel show higher luminance (e.g., 488, 477, 492) since these pixels are nearer to the power source at the bottom place. Therefore, the luminance/chromaticity at different positions of the panel is inconsistent. Since the entire image shows white color and all pixels are lit on, the overall OLED current is quite large, and the corresponding IR drop is also large. With the occurrence of IR drop, the voltage value ELVDD received by the pixels will gradually decrease from bottom to top, resulting in gradually decreasing luminance.

The right figure in FIG. 2B shows a full black image or dark image (the OPR equals 5%), except for a small area in the middle being lit up in white. The overall OLED current generated by this image is extremely small. Please note that, as can be seen by comparing the full white image with the full black image, even if the same luminance needs to be shown on a pixel at the same position, different image content may also cause the pixel to confront with the IR drop in different magnitudes. This is because the entire currents of the panel are different.

Figure 3:
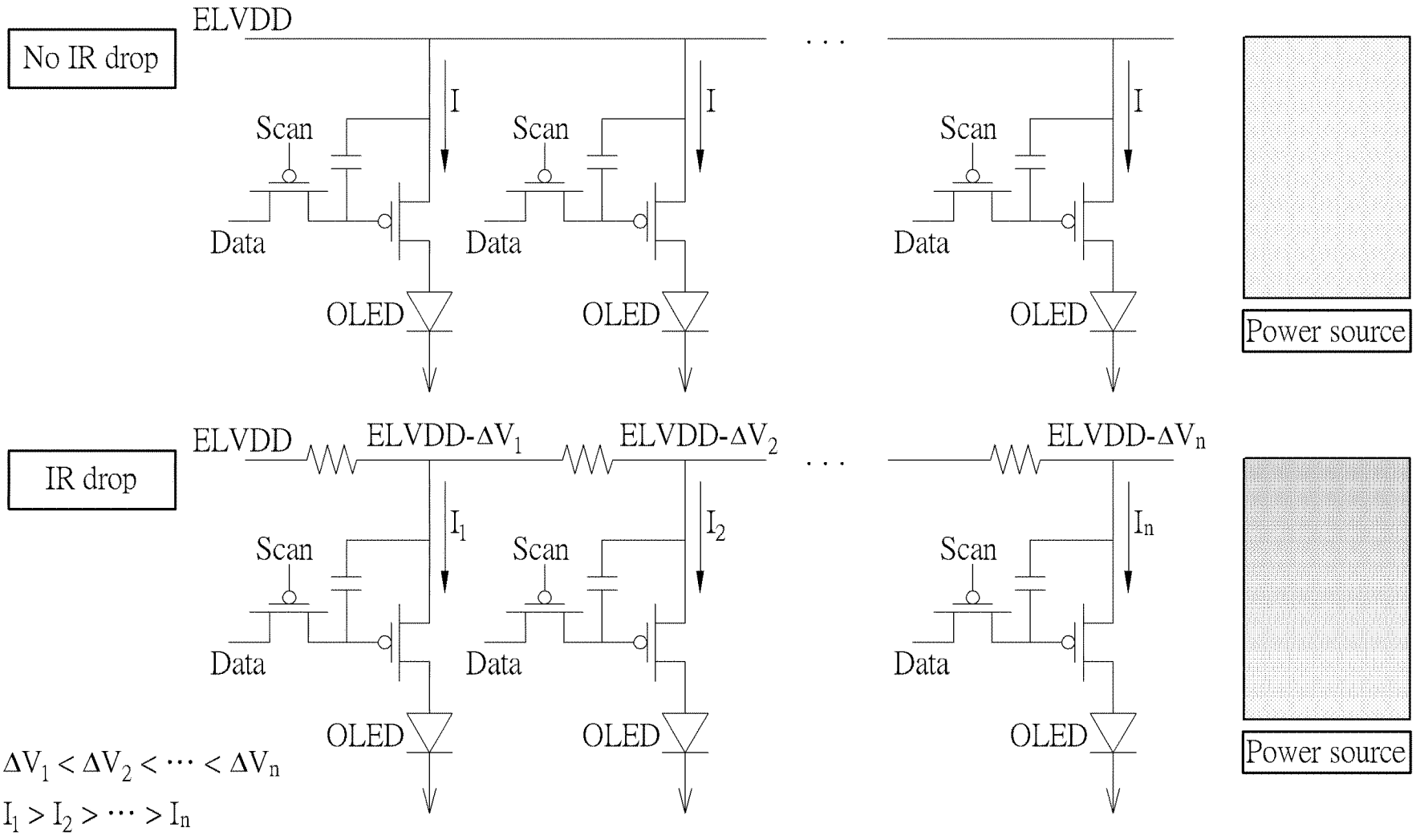
FIG. 3 illustrates the IR drop in a one-dimensional way.

Please refer to FIG. 3, which illustrates the IR drop in a one-dimensional way. In the absence of IR drop, all pixels receive the same power supply voltage ELVDD, and the luminance of the pixels at the position from near to far relative to the power source is also identical. In the existence of IR drop, there will be a voltage drop from the near end to the far end of the power source. The near end has a smaller voltage drop (i.e., $\Delta V_1$) and the voltage drop becomes larger with increasing distance (i.e., $\Delta V_1 < \Delta V_2 < \ldots < \Delta V_n$). Therefore, with the same image data, the OLEDs at the position nearer to the power source may receive greater current (i.e., $I_1$). As the distance from the power source becomes larger, the OLEDs at the position farther from the power source may receive less current (i.e., $I_1 > I_2 > \ldots > I_n$), which generates lower luminance. Therefore, a gradient luminance may appear on the panel due to the IR drop.

Figure 4:
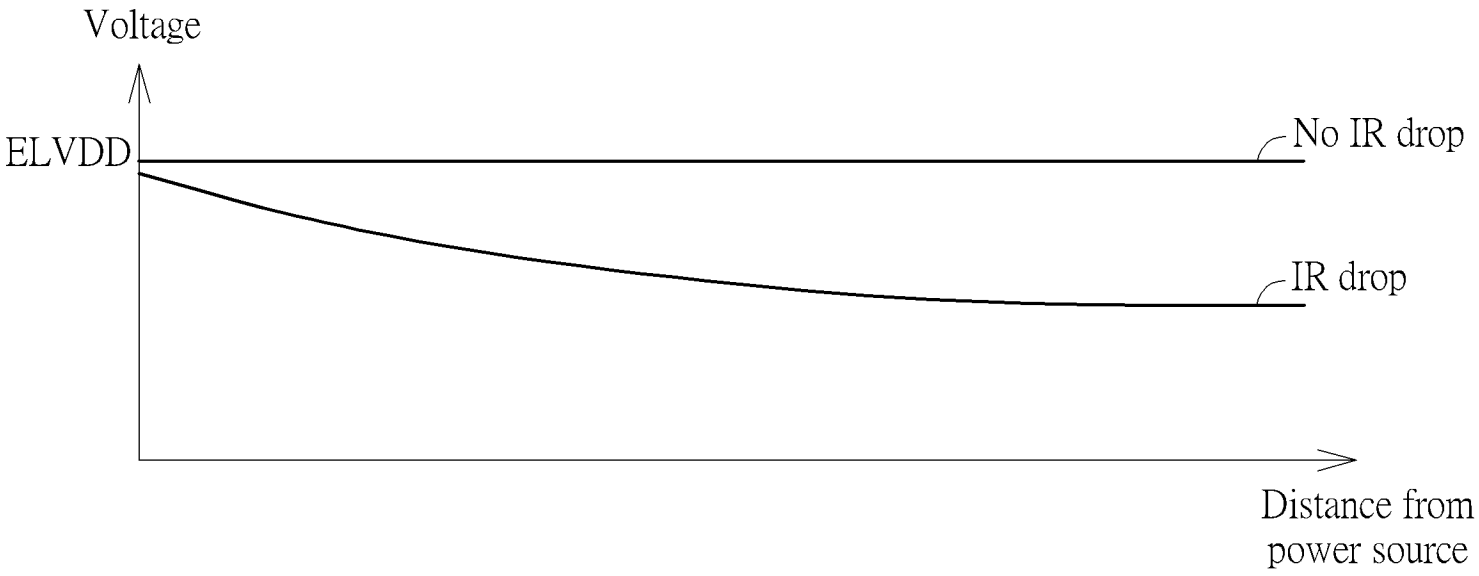
FIG. 4 illustrates curves of the power supply voltage from the near end to the far end of the power source.

The magnitude of the power supply voltage ELVDD from the near end to the far end of the power source may be expressed as the curves shown in FIG. 4. In general, the current passing through the power lines at the near end includes the current supplied to the entire panel, so it has a larger voltage drop. In contrast, when the current flows to the OLED in each pixel, the current that reaches the power lines at the far end becomes smaller and smaller, making the slope of voltage falling at the far end slow down gradually. In other words, when the IR drop exists, the slope of voltage drop at the near end of the power source is larger, and it gradually decreases toward the far end.

Figure 1:
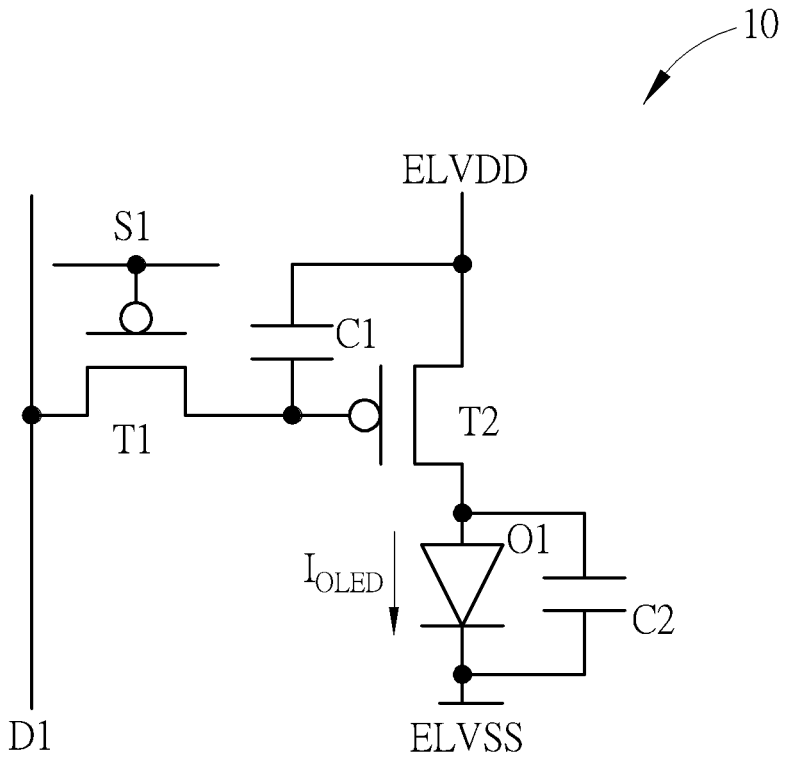
FIG. 1 PRIOR ART
FIG. 1 is a schematic diagram of a pixel of an OLED panel.
Figure 5:
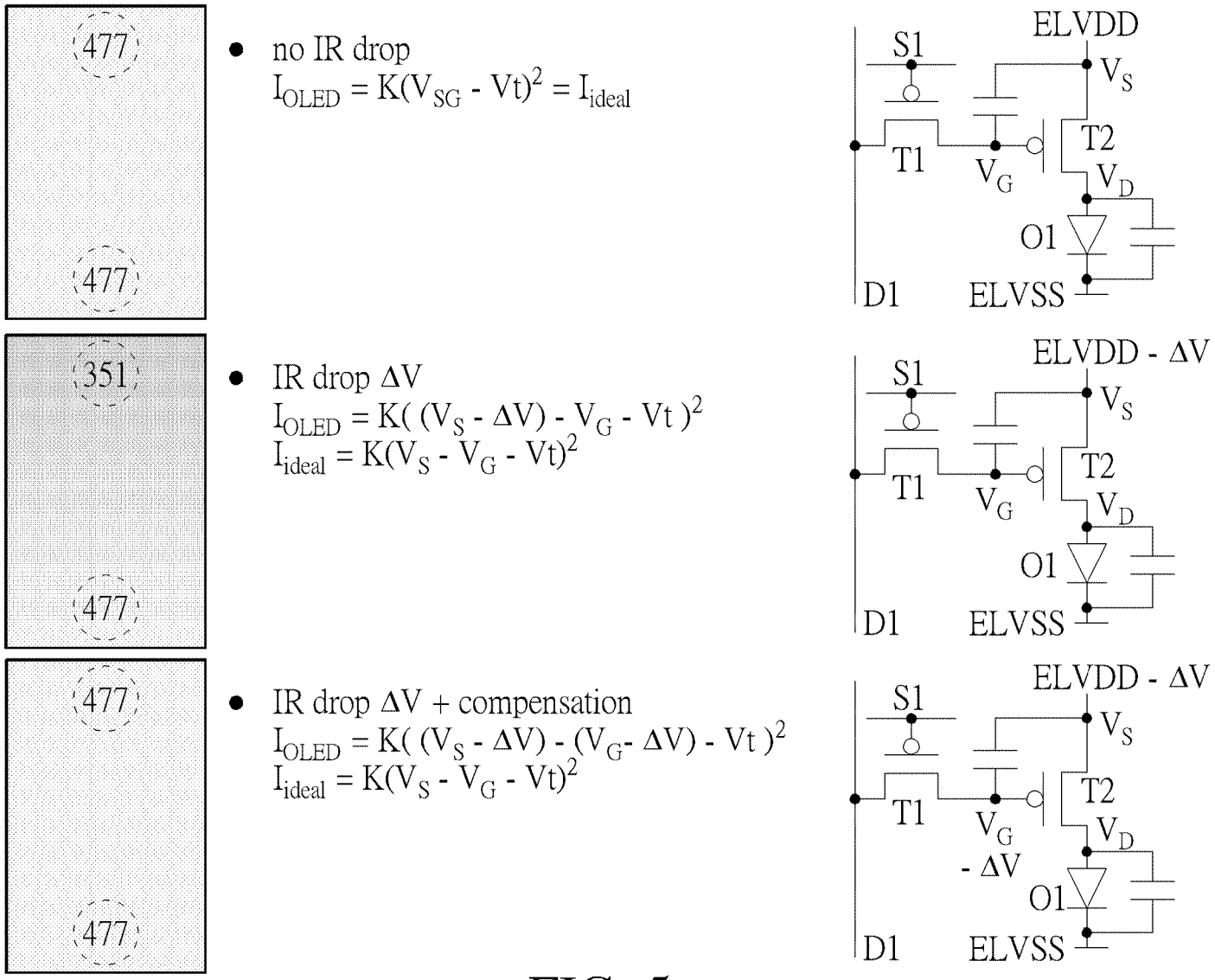
FIG. 5 is a schematic diagram of the effect of IR drop on the pixel voltage and the related compensation method.

Please refer to FIG. 5, which is a schematic diagram of the effect of IR drop on the pixel voltage and the related compensation method. The pixel structure shown in FIG. 1 is also included in FIG. 5 to facilitate the illustrations. As mentioned above, the current $I_{OLED}$ for driving the OLED O1 may be determined based on the source voltage $V_S$ and the gate voltage $V_G$ of the TFT T2. In the absence of IR drop, both the near-end and far-end pixels have ideal source voltage $V_S$ and gate voltage $V_G$, and the ideal current $I_{ideal}$ may be calculated accordingly. When the IR drop exists, the source voltage $V_S$ of the far-end and near-end pixels are different (i.e., with a voltage drop $-\Delta V$), resulting in different source-to-gate voltages $V_{SG}$. This makes the calculated current $I_{OLED}$ different from the ideal current $I_{ideal}$, which in turn leads to different luminance. A possible ideal compensation method is to subtract a voltage $\Delta V$ that equal to the drop level at the gate terminal, and the formula can show that the compensation voltage $-\Delta V$ and the IR drop $-\Delta V$ are canceled. Each pixel may acquire its corresponding IR drop magnitude, and the corresponding voltage is subtracted at the gate terminal; hence, the ideal current $I_{ideal}$ may be obtained in each pixel after compensation.

Figure 6:
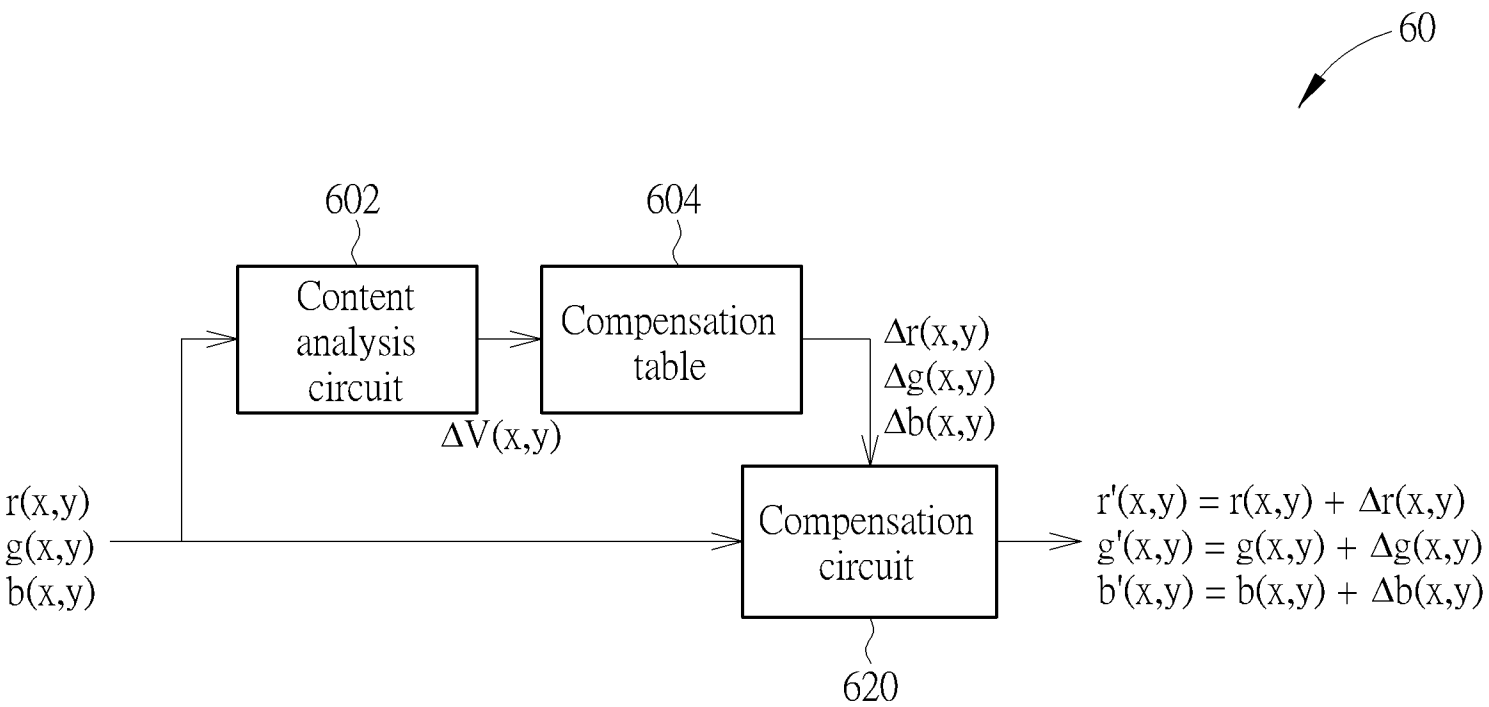
FIG. 6 is a block diagram of an image compensation circuit for IR drop compensation.

Please refer to FIG. 6, which is a block diagram of an image compensation circuit 60 for IR drop compensation. The image compensation circuit 60 may be included in a display driver circuit or a signal processing circuit of the timing controller or source driver for controlling the OLED panel. Based on the content of the received image, the image compensation circuit 60 may analyze the voltage drop at each position (x, y) to determine the magnitude of IR drop that may appear at each position, where x and y may represent the horizontal coordinate and vertical coordinate of the pixel. As shown in FIG. 6, the image compensation circuit 60 may include a content analysis circuit 602, a compensation table 604 and a compensation circuit 620. First, the input image data r(x, y), g(x, y) and b(x, y) having different colors may be received. The content analysis circuit 602 may analyze the content of the input image data r(x, y), g(x, y) and b(x, y) to obtain the voltage attenuation at each position, and generate the voltage attenuation value ΔV(x, y) of the pixels at different positions. The voltage attenuation value ΔV(x, y) may be determined based on the IR drop confronted by the corresponding pixel with respect to the position of the pixel and the OPR of the image, as the voltage drop −ΔV illustrated in FIG. 5 and related descriptions. Based on the compensation table 604, the voltage attenuation value ΔV(x, y) may further be converted into compensation values Δr(x, y), Δg(x, y) and Δb(x, y) having different colors for each pixel, which are added to the input image data r(x, y), g(x, y) and b(x, y), respectively, through the compensation circuit 620, in order to calculate the output image data r'(x, y), g'(x, y) and b'(x, y) as follows:

$$r'(x,y)=r(x,y)+\Delta r(x,y);$$

$$g'(x,y)=g(x,y)+\Delta g(x,y);$$

$$b'(x,y)=b(x,y)+\Delta b(x,y).$$

It should be noted that the voltage attenuation value ΔV(x, y) is a voltage value for compensating the IR drop voltage −ΔV as mentioned above. The voltage attenuation value ΔV(x, y) may be in the voltage domain, as distinct from the domain of the input image data r(x, y), g(x, y) and b(x, y). The voltage attenuation value ΔV(x, y) needs to be converted into the compensation values Δr(x, y), Δg(x, y) and Δb(x, y) that may be used for the image data and may be calculated in the image data domain. In general, the adjustment/compensation of the compensation values Δr(x, y), Δg(x, y) and Δb(x, y) may correspond to the same voltage difference.

Please also note that the voltage attenuation value ΔV(x, y) and the related compensation values Δr(x, y), Δg(x, y) and Δb(x, y) may be determined not only from the input image data r(x, y), g(x, y) or b(x, y) of the corresponding pixel, but also from the input image data of pixels other than the corresponding pixel on the display panel (e.g., r(x', y'), g(x', y') and b(x', y')). As mentioned above, the voltage attenuation value ΔV(x, y) may be calculated based on the IR drop confronted by the corresponding pixel, which is associated with the OPR of the image. The IR drop problem may be severer under a higher OPR. The OPR may be determined based on the image data of all pixels of the display panel. Therefore, the voltage attenuation value ΔV(x, y) and the related compensation value Δr(x, y), Δg(x, y) or Δb(x, y) for a pixel may preferably be determined in consideration of the input image data of this pixel and other pixels.

On the other hand, a transistor (such as TFT) usually has a channel length modulation (CLM) effect. Ideally, the drain current $I_D$ of the transistor in the saturation region may be a fixed value. However, considering the CLM effect, the drain current $I_D$ of the transistor may be different due to the drain-to-source voltage $V_D$S or the source-to-drain voltage $V_{SD}$; that is, the drain current $I_D$ increases slowly and linearly with the rise of $V_{DS}$ or $V_{SD}$; i.e., a factor $(1+\lambda\cdot V_{DS})$ for NMOS transistor or $(1+\lambda\cdot V_{SD})$ for PMOS transistor is added to the MOSFET formula, where A is a CLM parameter.

Figure 7:
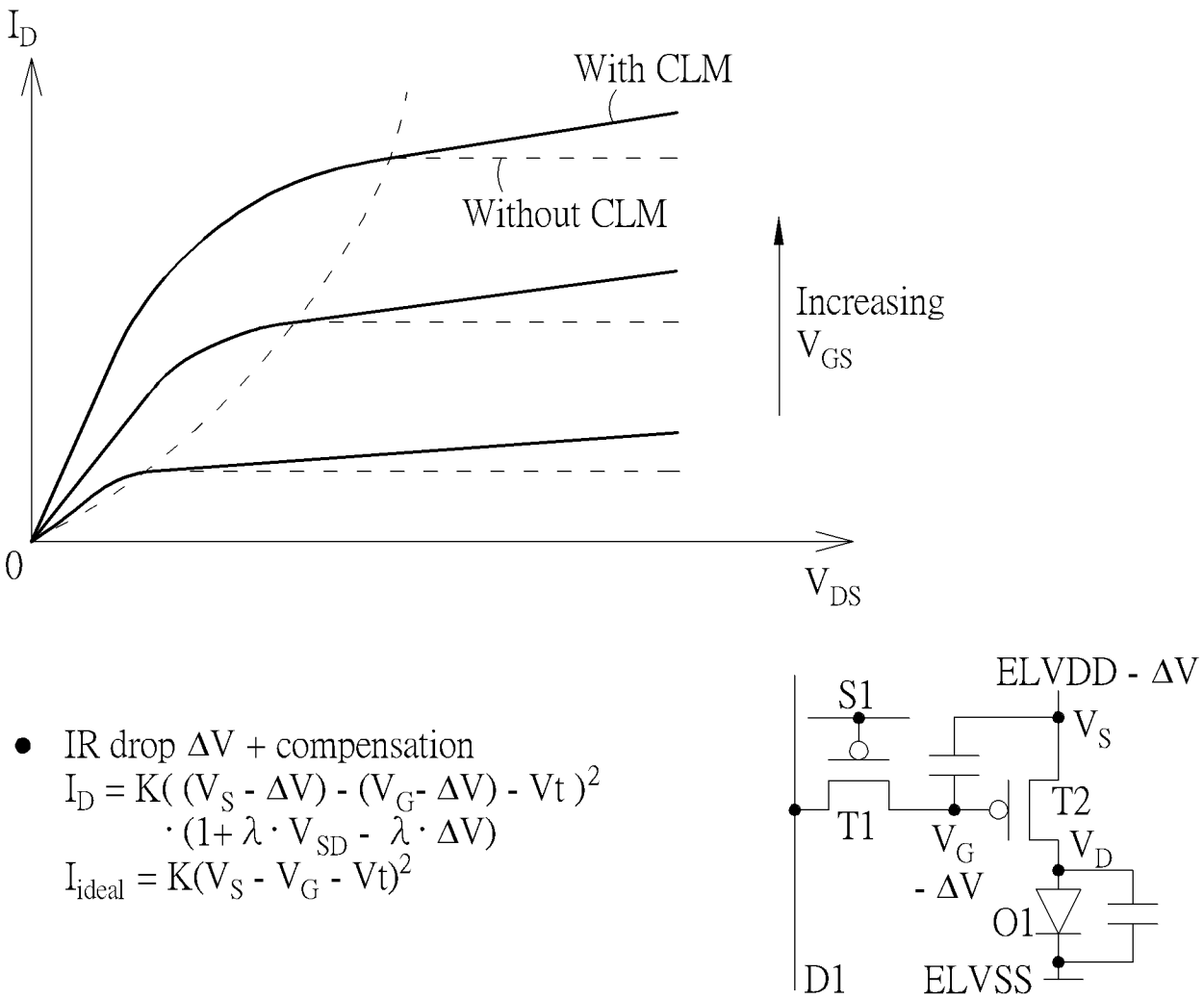
FIG. 7 is a schematic diagram of the CLM effect and related MOSFET formula.

As shown in FIG. 7, considering the CLM, the MOSFET formula with the IR drop compensation having the compensation voltage ΔV may be shown as follows:

$$I_D=K[(V_S-\Delta V)-(V_G-\Delta V)-Vt]^2\cdot(1+\Delta V_{SD}-\lambda\cdot V); \quad (1)$$

wherein K refers to the transconductance coefficient of the transistor (i.e., the TFT T2), and Vt refers to the threshold voltage of the transistor. As can be seen from Equation (1), although the IR drop voltage −ΔV is canceled by the compensation voltage, the term λ·ΔV may still cause a variation on the drain current $I_D$ under different magnitudes of IR drop, and the drain current $I_D$ is served as the OLED current $I_{OLED}$ that drives the OLED O1 to illuminate.

As a result, the abovementioned compensation method and calculation formula for IR drop will not be sufficient to cope with the phenomenon of CLM; hence, the finally obtained output image data r'(x, y), g'(x, y) and b'(x, y) may still have errors due to the CLM. In other words, the factor λ·ΔV associated with the CLM in the output image data r'(x, y), g'(x, y) and b'(x, y) should be eliminated, in order to obtain an ideal OLED current in each pixel to improve the consistency of the luminance of the OLED panel.

Figure 8:
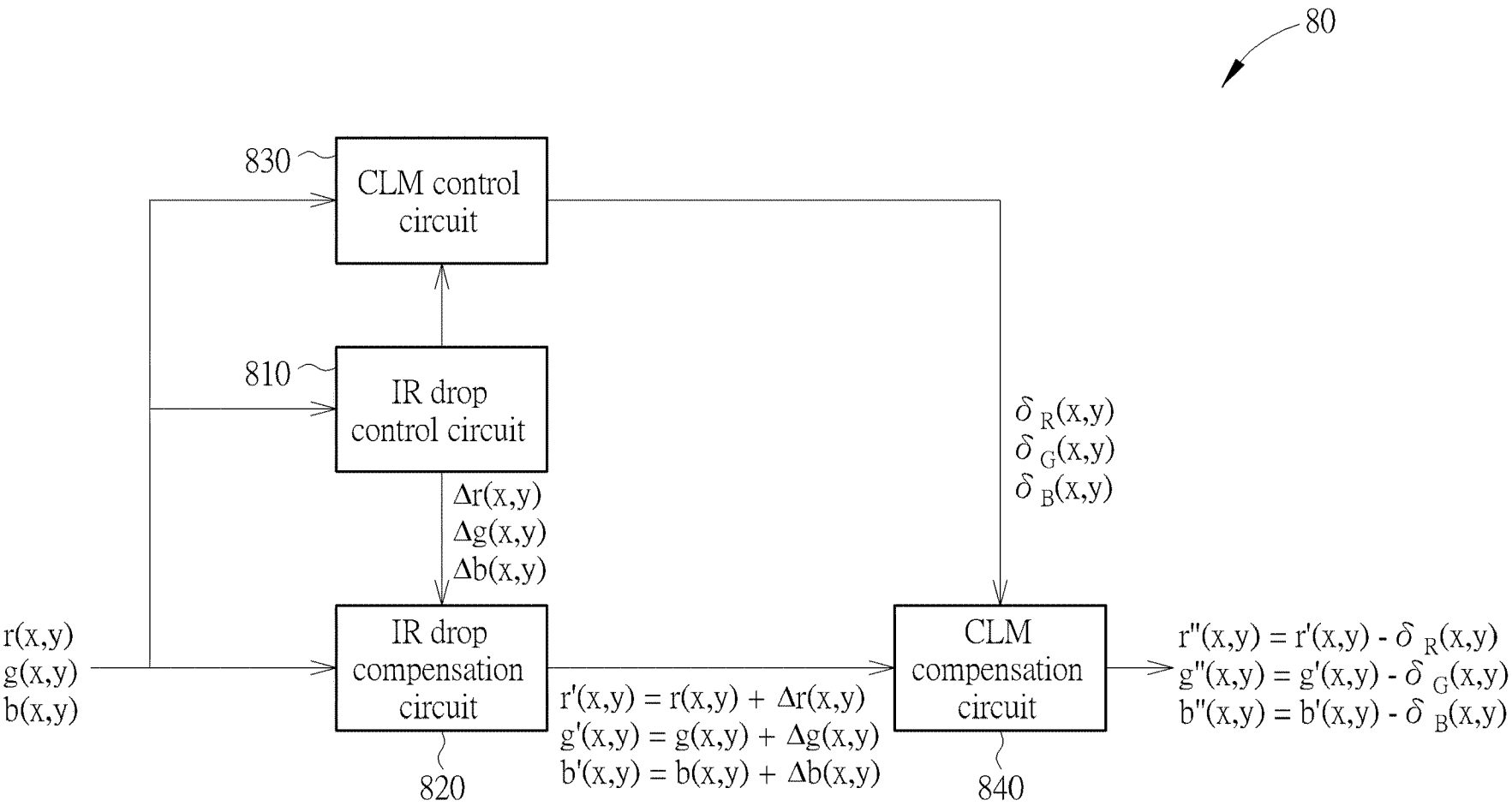
FIG. 8 is a schematic diagram of an image compensation circuit according to an embodiment of the present invention.

Please refer to FIG. 8, which is a schematic diagram of an image compensation circuit 80 according to an embodiment of the present invention. The image compensation circuit 80 may be included in a display driver circuit or a signal processing circuit of the timing controller or source driver for controlling the OLED panel. As shown in FIG. 8, the image compensation circuit 80 may include an IR drop control circuit 810, an IR drop compensation circuit 820, a CLM control circuit 830 and a CLM compensation circuit 840. The IR drop control circuit 810 may receive input image data r(x, y), g(x, y) and b(x, y) for pixels of a display panel (not illustrated), and generate compensation values Δr(x, y), Δg(x, y) and Δb(x, y) for the pixels according to the input image data r(x, y), g(x, y) and b(x, y). The IR drop compensation circuit 820 thereby compensates the input image data r(x, y), g(x, y) and b(x, y) with the compensation values Δr(x, y), Δg(x, y) and Δb(x, y), e.g., adds the compensation values Δr(x, y), Δg(x, y) and Δb(x, y) to the input image data r(x, y), g(x, y) and b(x, y) to generate intermediate image data r'(x, y), g'(x, y) and b'(x, y). The CLM control circuit 830 may receive the input image data r(x, y), g(x, y) and b(x, y) and also receive information associated with the compensation values Δr(x, y), Δg(x, y) and Δb(x, y) from the IR drop control circuit 810, and generate compensation values $\delta_R$(x, y), $\delta_G$(x, y) and $\delta_B$(x, y) for the pixels according to the compensation values Δr(x, y), Δg(x, y) and Δb(x, y). The CLM compensation circuit 840 thereby compensates the input image data r(x, y), g(x, y) and b(x, y) with the compensation values $\delta_R$(x, y), $\delta_G$(x, y) and $\delta_B$(x, y) to generate the output image data r"(x, y), g"(x, y) and b"(x, y), e.g., subtracts the compensation values $\delta_R$(x, y), $\delta_G$(x, y) and $\delta_B$(x, y) from the intermediate image data r'(x, y), g'(x, y) and b'(x, y). That is, the output image data r"(x, y), g"(x, y) and b"(x, y) may be obtained as:

$$r''(x,y)=r'(x,y)-\delta_R(x,y);$$

$$g''(x,y)=g'(x,y)-\delta_G(x,y);$$

$$b''(x,y)=b'(x,y)-\delta_B(x,y).$$

Note that the compensation values Δr(x, y), Δg(x, y) and Δb(x, y) are generated by considering the voltage drop or IR drop appearing on each pixel of the display panel, and thus correspond to the compensation for voltage drop. An exemplary implementation of the IR drop compensation is illustrated in FIGS. 5 and 6 and related descriptions. The compensation values $\delta_R$(x, y), $\delta_G$(x, y) and $\delta_B$(x, y) are generated by considering the CLM effect of each pixel, so as to compensate for the errors due to the CLM effect.

As mentioned above, the compensation values Δr(x, y), Δg(x, y) and Δb(x, y) for IR drop are determined in consideration of the input image data of the corresponding pixel and other pixels due to different OPRs of the image. Since the compensation values $\delta_R(x, y)$, $\delta_G(x, y)$ and $\delta_B(x, y)$ for CLM effect are generated based on the information associated to the compensation values Δr(x, y), Δg(x, y) and Δb(x, y) corresponding to IR drop, where different image data in the frame may lead to different magnitudes of IR drop, the compensation values $\delta_R(x, y)$, $\delta_G(x, y)$ and $\delta_B(x, y)$ may also be determined in consideration of the input image data of the corresponding pixel and other pixels. Please also note that the compensation values $\delta_R(x, y)$, $\delta_G(x, y)$ and $\delta_B(x, y)$ for CLM effect may be different under different compensation values Δr(x, y), Δg(x, y) and Δb(x, y) for IR drop.

Figure 9:
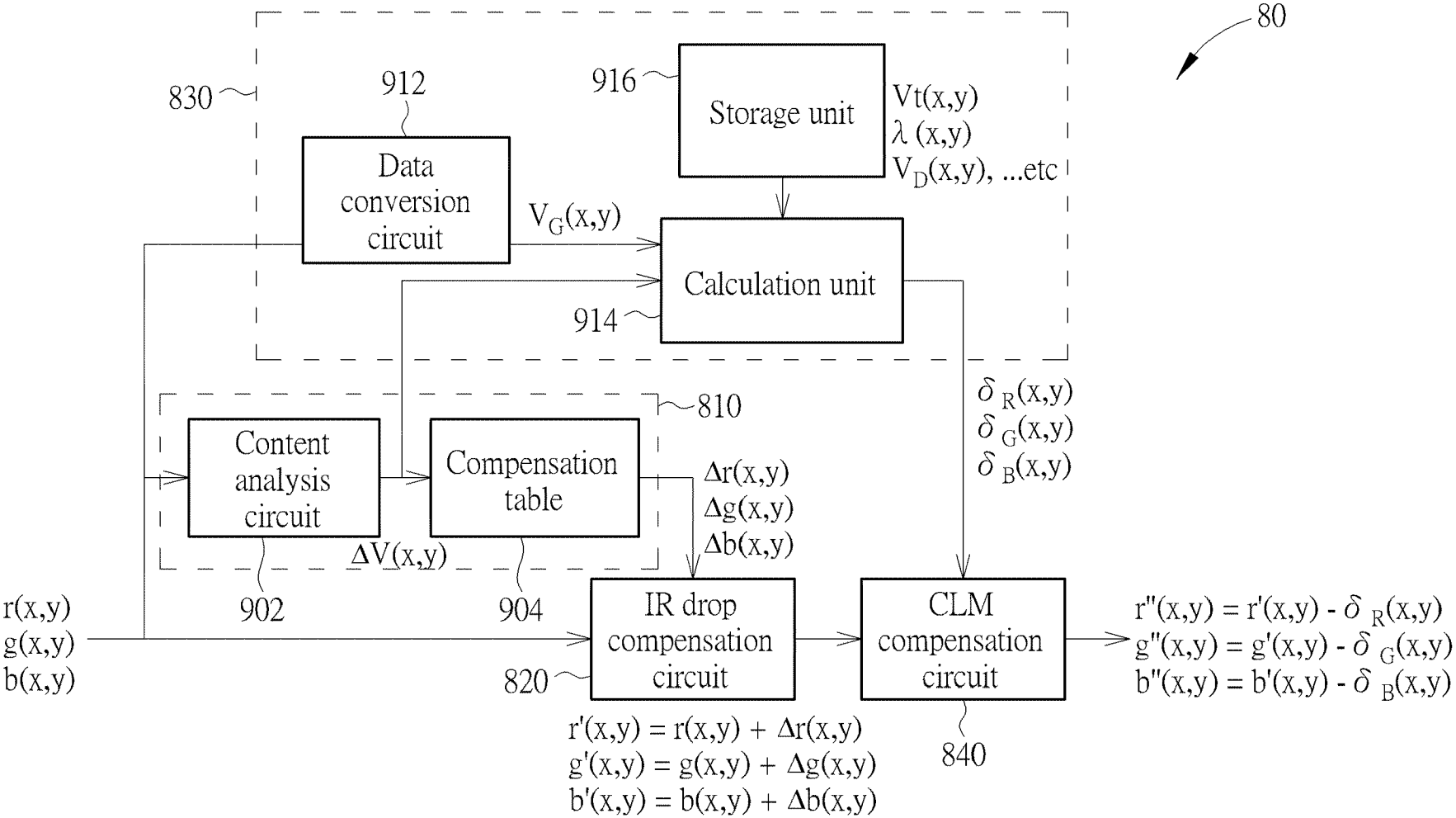
FIG. 9 illustrates a detailed implementation of the image compensation circuit shown in FIG. 8.

Please refer to FIG. 9, which illustrates a detailed implementation of the image compensation circuit 80. As shown in FIG. 9, the IR drop control circuit 810 includes a content analysis circuit 902 and a compensation table 904. The detailed implementations and operations of the content analysis circuit 902, the compensation table 904 and the IR drop compensation circuit 820 are similar to those of the content analysis circuit 602, the compensation table 604 and the compensation circuit 620 as shown in FIG. 6, and will be omitted herein for brevity. The IR drop compensation circuit 820 may incorporate the compensation values Δr(x, y), Δg(x, y) and Δb(x, y) into the input image data r(x, y), g(x, y) and b(x, y) to generate the intermediate image data r'(x, y), g'(x, y) and b'(x, y). In addition, as shown in FIG. 9, the CLM control circuit 830 includes a data conversion circuit 912, a calculation unit 914 and a storage unit 916. The calculation unit 914 may be any logic circuit capable of calculation functions, and may be implemented in the timing controller or source driver of the display system. The storage unit 916 may be any type of volatile or non-volatile memories. Examples of the storage unit 916 include but are not limited to a read-only memory (ROM), flash memory, random-access memory (RAM), CD-ROM/DVD-ROM, magnetic tape, hard disk and optical data storage device.

Figure 10:
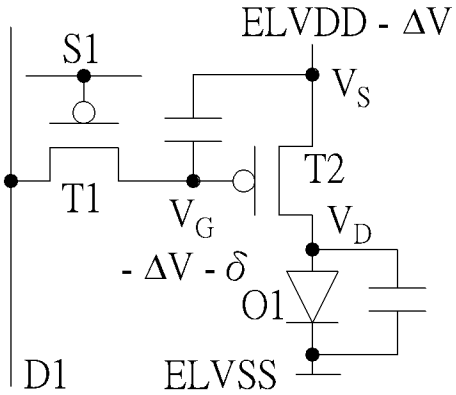
FIG. 10 illustrates the compensation for the IR drop and CLM effect on the pixel voltage.

Please refer to FIG. 10, which illustrates the compensation for the IR drop and CLM effect on the pixel voltage. The pixel structure shown in FIG. 1 is also included in FIG. 10 to facilitate the illustrations. As shown in FIG. 10, in addition to the compensation value −ΔV for IR drop, a compensation value −δ is also included in the gate voltage $V_G$ of the TFT T2; hence, the MOSFET formula may be shown as follows:

$$I_D=K[(V_S-\Delta V)-(V_G-\Delta V-\delta)-Vt]^2\cdot(1+\lambda\cdot V_{SD}-\lambda\cdot\Delta V). \quad (2)$$

Therefore, the calculation of δ may be derived according to the MOSFET formula in Equation (2), and it is associated with various parameters such as $V_S$, $V_G$, Vt, λ, $V_D$ and ΔV, and may be expressed as the following equation:

$$\delta(V_G, V_D, Vt, \lambda, \Delta V) = (V_S - V_G - Vt)\cdot\left(\sqrt{\frac{1}{1+\lambda\cdot V_{SD}-\lambda\cdot\Delta V}}-1\right); \quad (3)$$

wherein $V_S$ and ΔV are associated with the degree of IR drop, i.e., ΔV represents the magnitude of voltage drop and $V_S$ represents the source voltage of the TFT T2 under the voltage drop ΔV; $V_D$ represents the drain voltage of the TFT T2 and is associated with the device characteristics of the OLED O1 because the drain terminal of the TFT T2 is coupled to the OLED O1 and its voltage is affected by the device characteristics of the OLED O1; $V_G$ represents the gate voltage of the TFT T2 and is associated with the voltage of the image data, i.e., the gate terminal of the TFT T2 is coupled to the data line for receiving the image data voltage; Vt and λ are associated with the device characteristics of the TFT T2, where Vt is the threshold voltage and λ is the CLM parameter.

Please continue to refer to FIG. 10 together with FIG. 9. The parameters shown in Equation (3) may be sent to the calculation unit 914 to calculate the compensation values $\delta_R(x, y)$, $\delta_G(x, y)$ and $\delta_B(x, y)$ for CLM compensation. In detail, the input image data r(x, y), g(x, y) and b(x, y) may be sent to the data conversion circuit 912, which converts the input image data into voltage information included in the gate voltage $V_G(x, y)$ and send the gate voltage $V_G(x, y)$ to the calculation unit 914. The calculation unit 914 may further obtain the information of IR drop ΔV(x, y) from the content analysis circuit 902. In addition, the device characteristics of the pixels may be provided for the calculation unit 914 to calculate the compensation values $\delta_R(x, y)$, $\delta_G(x, y)$ and $\delta_B(x, y)$. The device characteristics may include the CLM parameter X of the TFT T2, and also include the threshold voltage Vt of the TFT T2 and the operation voltage of the OLED O1, which is represented as the drain voltage $V_D$ of the TFT T2. These parameters may be stored in the storage unit 916, e.g., in form of a lookup table (LUT), and sent to the calculation unit 914 to perform the calculation. For example, as for a pixel on the position (x, y) of the display panel, the calculation unit 914 may take the parameters λ(x, y), Vt(x, y) and $V_D(x, y)$ corresponding to the pixel from the storage unit 916 and perform the CLM calculation. After obtaining the above information, the calculation unit 914 may calculate the compensation values $\delta_R(x, y)$, $\delta_G(x, y)$ and $\delta_B(x, y)$ corresponding to each pixel. As a result, the CLM compensation circuit 840 may incorporate the compensation values $\delta_R(x, y)$, $\delta_G(x, y)$ and $\delta_B(x, y)$ into the intermediate image data r'(x, y), g'(x, y) and b'(x, y) to generate the output image data r"(x, y), g"(x, y) and b"(x, y).

In other words, according to the structure of the image compensation circuit 80 shown in FIGS. 8 and 9, in addition to considering the compensation values for IR drop (Δr/Δg/ab), the compensation may also be performed according to the compensation values for CLM ($\delta_R/\delta_G/\delta_B$). The parameters for the pixels on different coordinates may be different. The image compensation circuit 80 may obtain the parameters such as the input image data and the device characteristics corresponding to each pixel, and thereby calculate the compensation values to be used for each pixel. After the IR drop compensation circuit 820 performs the first stage of compensation, the CLM compensation circuit 840 may perform the second stage of compensation, in order to completely eliminate the influences of the IR drop and the CLM effect on the image luminance.

Please note that the compensation values $\delta_R(x, y)$, $\delta_G(x, y)$ and $\delta_B(x, y)$ for CLM include various information containing the input image data, IR drop information, and device characteristics; hence, the calculation of the compensation values $\delta_R(x, y)$, $\delta_G(x, y)$ and $\delta_B(x, y)$ will be quite complex in consideration of all the information, as Equation (3) mentioned above. Due to the limitations of hardware architecture or cost, in some embodiments, a simplified method may be used to derive the compensation values $\delta_R(x, y)$, $\delta_G(x, y)$ and $\delta_B(x, y)$. For example, the complete derivation of the compensation value δ may include 5 variables; namely the calculation formula of 5-dimension (5D):

$$5D:\ \delta(V_G, V_D, \lambda, \Delta V).$$

In order to save the storage space, we can choose to use fewer variables and calculate in a smaller dimension, such as:

$$4D: \delta(V_D, Vt, \lambda, \Delta V), \delta(V_G, Vt, \lambda, \Delta V), \ldots, \text{etc.};$$

$$3D: \iota(Vt, \lambda, \Delta V), \delta(V_G, V_D, Vt), \ldots, \text{etc.};$$

$$2D: \delta(Vt, \lambda), \delta(V_G, V_D), \ldots, \text{etc.}$$

Other parameters that are not used as variables in the calculation of smaller dimension may be estimated or predetermined. In addition, in some embodiments, only the parameter information of partial pixels is stored in the storage unit 916 (e.g., as an LUT), and the parameter values of other pixels may be calculated through interpolation. In the calculation of the parameters for the compensation value δ, each parameter may be selectively used or omitted, and the calculation method using all or partial parameters should not be used to limit the scope of the present invention.

Please note that in some embodiments of the present invention, the compensation operations may be divided into two stages, where the information of the compensation value ΔV for IR drop in the first stage may be used to calculate the compensation value δ of the second stage, in order to further compensate for the errors caused by the CLM effect. The compensation methods provided in the embodiments of the present invention are different from the conventional compensation methods which only perform one-stage compensation for IR drop or for Mura.

Figure 11:
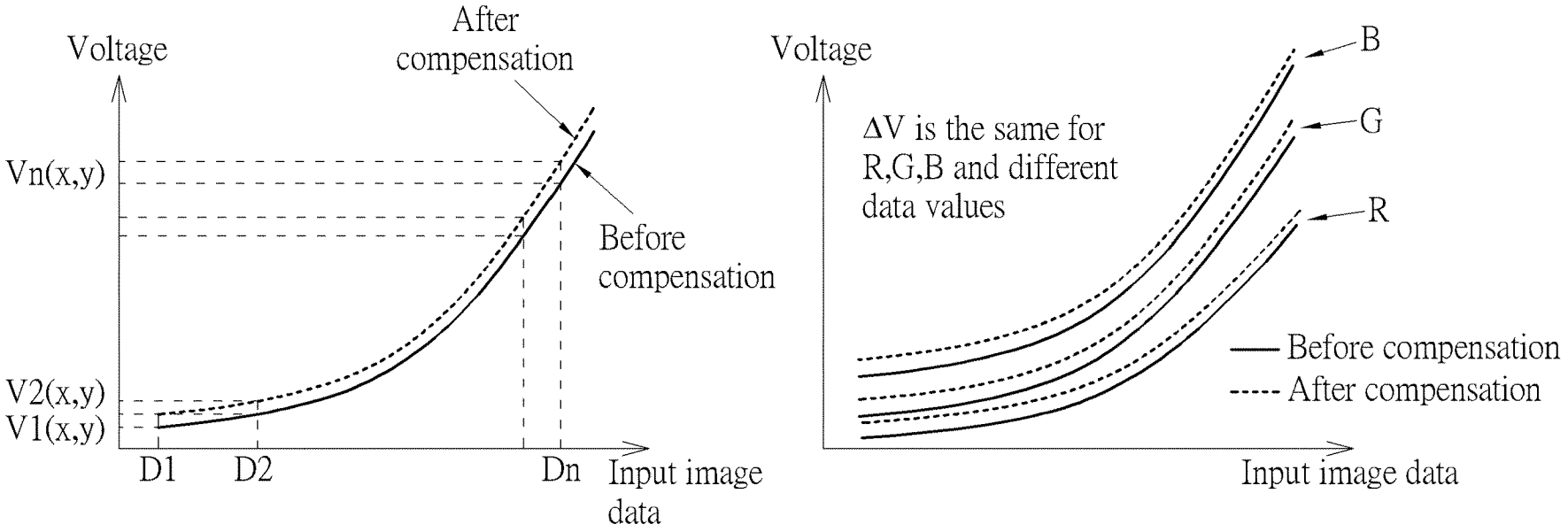
FIG. 11 shows a line graph with data-to-voltage curves before and after compensation for the IR drop only.

In the conventional compensation method, when only the IR drop is considered (not considering the CLM effect), the same voltage compensation value may be obtained for different input data values or grayscale values of RGB (i.e., red, green, blue) at a certain coordinate (x, y), as shown in FIG. 11. This is because the pixels at the same position receive the power supply voltage on the same metal surface, so the IR drop on the same coordinate should be identical. In addition, there is a difference between three data-to-voltage curves of RGB. This is because the emission characteristics of RGB OLED and/or the requirements of white point color coordinates are different. Therefore, the driving voltages corresponding to RGB input data may be different, but the voltage compensation required for IR drop may be identical.

More specifically, FIG. 11 illustrates the compensation values of the IR drop compensation without considering the CLM effect. The left figure of FIG. 11 shows a line graph with data-to-voltage curves before and after compensation for a certain coordinate (x, y) under various values of input image data D1-Dn, which are converted into voltage values V1(*x, y*)-Vn(x, y), respectively. It can be seen that the compensation values are identical regardless of the value of the image data (the same vertical distance between the two curves). The right figure of FIG. 11 shows a line graph with data-to-voltage curves before and after compensation for different colors RGB at the same coordinate. It can be seen that the compensation values of RGB having different data values are also identical. Please note that a still image is considered in this case, i.e., the RGB compensation values at the same coordinate under the same image are identical. If the panel is switched to show another image frame, the overall current may change due to different OPRs in different images; hence, different magnitudes of IR drop may be generated, and different compensation values may be correspondingly obtained. Note that in the same image frame, different coordinates may also possess different magnitudes of IR drop, and different compensation values may be correspondingly obtained.

Figure 12:
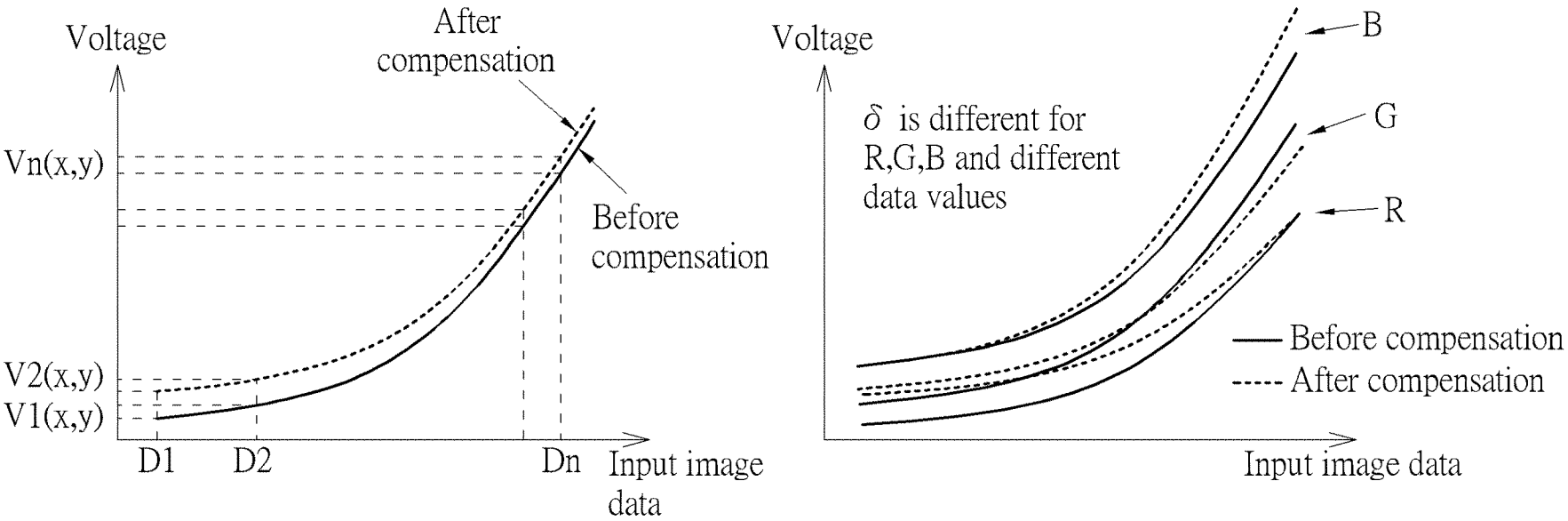
FIG. 12 shows a line graph with data-to-voltage curves before and after compensation for the IR drop including the CLM effect.

In contrast, the compensation method of the present invention further considers the CLM effect, and thus different colors at a certain coordinate (x, y) may have different compensation values δ. The compensation values δ may also vary with different channels, image data values, and/or different TFT or OLED characteristics. The left figure of FIG. 12 shows a line graph with data-to-voltage curves before and after compensation for a certain coordinate (x, y) under various values of input image data D1-Dn, which are converted into voltage values V1(*x, y*)-Vn(x, y), respectively. It can be seen that the compensation values δ are different under different values of the image data (different vertical distances between the two curves under different data values). In other words, if the image data of two pixels are different, the compensation values δ for these two pixels may be different regardless of the position of these two pixels. The right figure of FIG. 12 shows a line graph with data-to-voltage curves before and after compensation for different colors RGB at the same coordinate. It can be seen that the compensation values δ of RGB having different data values are different. As for the same input image data, the compensation values δ may be different if the corresponding pixels have different colors RGB.

The difference between the features of IR drop and Mura compensation will be explained hereinafter. The so-called Mura compensation (Demura) is to compensate for the variance between TFT and OLED characteristics of each pixel in the process. Different pixels may have different TFT parameters (e.g., the transconductance coefficient K and the threshold voltage Vt) and/or different OLED parameters (e.g., the luminance parameter β). For Demura, different colors RGB may also have different device characteristics. The Mura phenomenon may generate a noise or mark appearing on a pure color image caused by differences in luminance between pixels. When the overall luminance is lower, the Mura phenomenon will be more obvious.

In contrast, the IR drop refers to a voltage drop appearing when the current flows through parasitic resistors on the metal surface for supplying power supply voltage, causing the source voltage of the TFT to decrease. The source-to-gate voltage $V_{SG}$ of the TFT and the luminance of the pixel also decrease accordingly. The pixel farther from the power source may have a lower power supply voltage, which leads to lower luminance; while the pixel nearer to the power source may have a higher power supply voltage, which leads to higher luminance. This results in inconsistent luminance in different display areas under the same grayscale image. When the overall luminance is higher, the IR drop phenomenon will be more obvious.

Therefore, the compensation scheme for IR drop and CLM effect as provided in the present invention is different from the conventional Demura compensation in several aspects.

First, the compensation value of Demura is only associated with the device characteristics of the corresponding pixel and has nothing to do with other pixels. In comparison, the compensation value of IR drop is affected by the image content, where a brighter image frame may cause a larger IR drop. Since the compensation of CLM effect is also associated with the power supply voltage received by the pixel, the compensation value of CLM effect is also affected by the image content. In such a situation, even if the input image data for different pixels at different locations of the display panel are the same, the compensation values for CLM effect for these pixels may be different. In general, those pixels farther from the power source may require greater compensation values.

Second, as for the Demura compensation, when the overall luminance is lower, the compensation effect will be more evident due to the feature of more obvious Mura phenomenon under lower luminance. In comparison, as for the IR drop compensation, when the overall luminance is higher, the compensation effect will be more evident due to the feature of more obvious IR drop phenomenon under higher luminance. In this regard, the compensation scheme of the present invention (including compensations for IR drop and CLM effect) is similar to the IR drop compensation, where the compensation effect may be more evident when the overall luminance is higher.

Third, the Mura phenomenon is resulted from process variations between pixels, and thus the compensation values for Demura may be irregular. In comparison, the compensation values for IR drop are smooth and have high regularity, where the compensation values for pixels farther from the power source are usually larger and the compensation values for pixels nearer to the power source are usually smaller. As for the compensation scheme of the present invention that includes compensations for IR drop and CLM effect, the compensation values may include high-frequency irregular components and low-frequency regular components. This is because the CLM compensation refers to both the information of IR drop and the information of device characteristics of the pixels.

Finally, it should be noted that the compensation for only IR drop and the compensation scheme in consideration of both IR drop and CLM effect are also different. As for the IR drop compensation, the compensation values for different colors RGB in a certain pixel at a specific position may be identical, as shown in FIG. 11. In comparison, as for the compensation scheme in consideration of both the IR drop and CLM effect, the compensation values for different colors RGB in a certain pixel at a specific position may be different, as shown in FIG. 12. Note that the Demura compensation also has different compensation values for different colors at the same position due to different device characteristics of RGB OLEDs.

As can be seen, the compensation scheme in consideration of both the IR drop and CLM effect includes several features different from the general IR drop compensation and also includes several features different from the Demura compensation.

Figure 13:
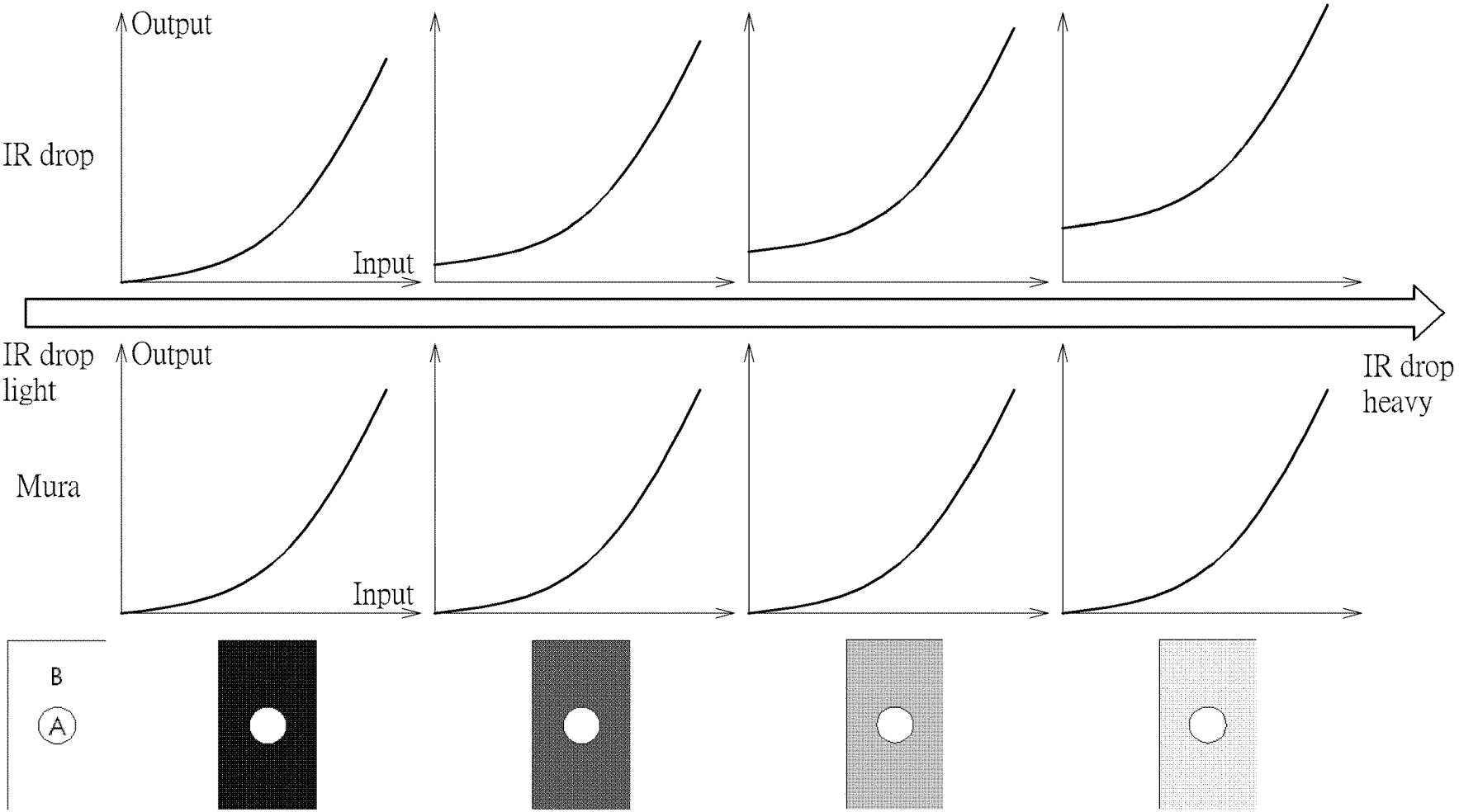
FIG. 13 is a schematic diagram illustrating the difference between the compensations for the IR drop and Mura phenomenon.

Please refer to FIG. 13, which further illustrates the difference between the compensations for the IR drop and Mura phenomenon with diagrams. The waveform diagrams of FIG. 13 represent the relationship between the input and output image data observed in area A when the luminance of area B varies. In detail, the compensation value of IR drop (or also considering the CLM effect) for a certain pixel may change due to changes in other pixels on the display panel, as shown in the upper half part of FIG. 13. More specifically, a higher luminance of the image frame may result in a heavier IR drop, and thus higher compensation values may be required. In contrast, the compensation value of Demura for a certain pixel may not change when the image content in other pixels on the display panel changes, as shown in the lower half part of FIG. 13.

Please note that the present invention aims at providing an image compensation circuit and a compensation method capable of compensating for both the IR drop and the CLM effect. Those skilled in the art may make modifications and alterations accordingly. For example, the image compensation circuit and method of the present invention may be applicable to any type of pixel structure, such as the active matrix OLED (AMOLED) pixel shown in FIG. 1. In another embodiment, the image compensation circuit and method of the present invention may be used for other type of pixels. For example, the OLED in the pixel may be replaced by any other type of light emitting device. Alternatively or additionally, the pixel structure may apply NMOS driving, where an NMOS transistor is used to drive the OLED to illuminate. In the above embodiments, a TFT process is implemented on the panel and thus the TFTs are included in the pixels. Those skilled in the art should understand that the implementations of the transistors in the pixels are not limited thereto. In addition, the image compensation circuit and method of the present invention may be implemented in any of the data code, gamma code, or gamma voltage.

Figure 14:
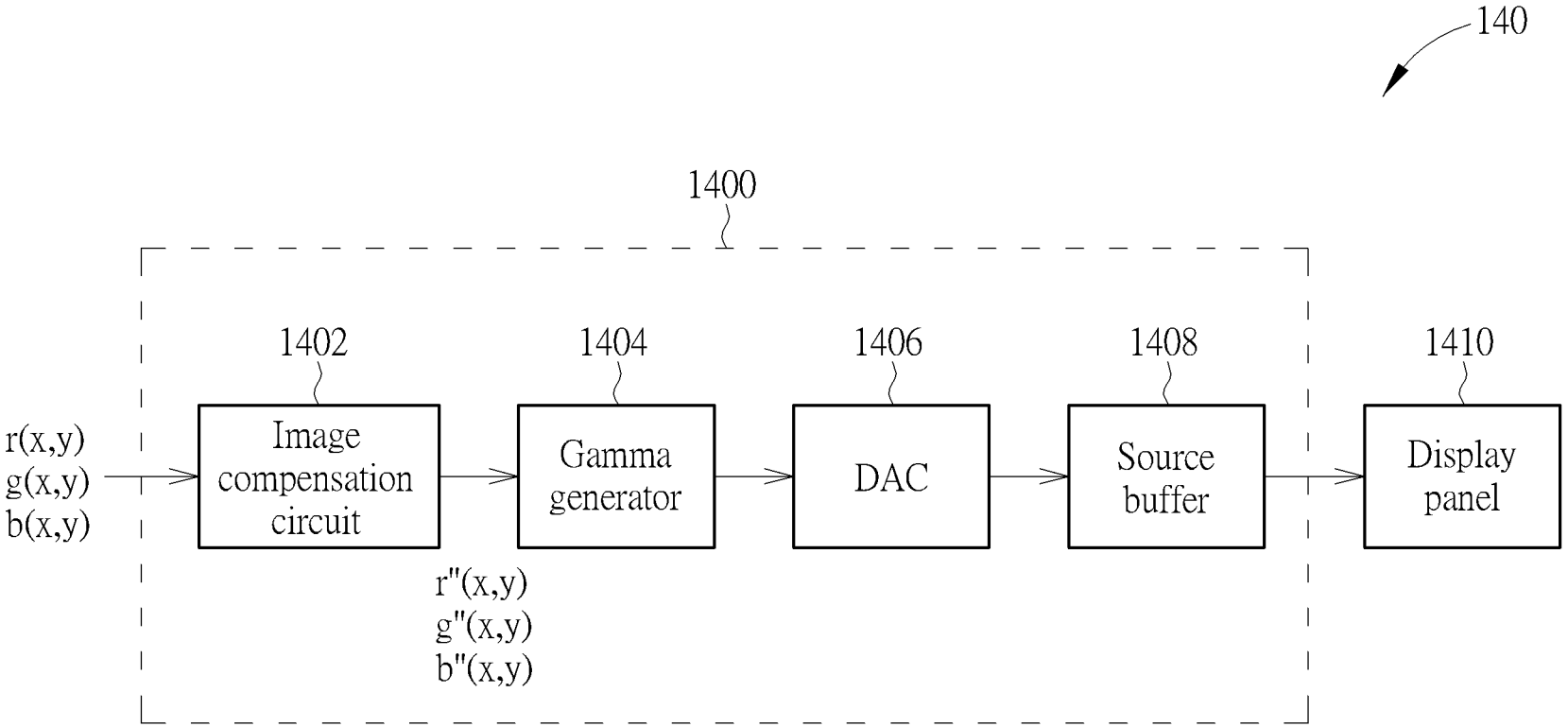
FIG. 14 is a schematic diagram of a display system according to an embodiment of the present invention.

Please refer to FIG. 14, which is a schematic diagram of a display system 140 according to an embodiment of the present invention. As shown in FIG. 14, the display system 140 includes a display driver circuit 1400 and a display panel 1410. The display driver circuit 1400 may drive the display panel 1410 to show desired images. In detail, the display driver circuit 1400 includes an image compensation circuit 1402, a gamma generator 1404, a digital-to-analog converter (DAC) 1406 and a source buffer 1408. The image compensation circuit 1402 may include a structure similar to the structure of the image compensation circuit 80 as shown in FIGS. 8 and 9. The gamma generator 1404 may generate gamma codes according to the image data r"(x, y), g"(x, y) and b"(x, y) received from the image compensation circuit 1402. The DAC 1406 thereby converts the gamma codes into corresponding gamma voltages. The source driver 1408 may output the gamma voltages to the display panel 1410.

In this embodiment, the image compensation circuit 1402 may receive the input image data r(x, y), g(x, y) and b(x, y), perform compensation on the input image data r(x, y), g(x, y) and b(x, y) to generate the output image data r"(x, y), g"(x, y) and b"(x, y), and output the output image data r"(x, y), g"(x, y) and b"(x, y) to the follow-up circuitry. More specifically, in the image compensation circuit 1402, the IR drop compensation may be performed on the input image data r(x, y), g(x, y) and b(x, y) to generate the intermediate image data r'(x, y), g'(x, y) and b'(x, y), and the CLM compensation may be performed on the intermediate image data r'(x, y), g'(x, y) and b'(x, y) to generate the output image data r"(x, y), g"(x, y) and b"(x, y). The detailed implementations and operations of the image compensation circuit 1402 are similar to those illustrated in the above descriptions, and will not be narrated herein.

Figure 15:
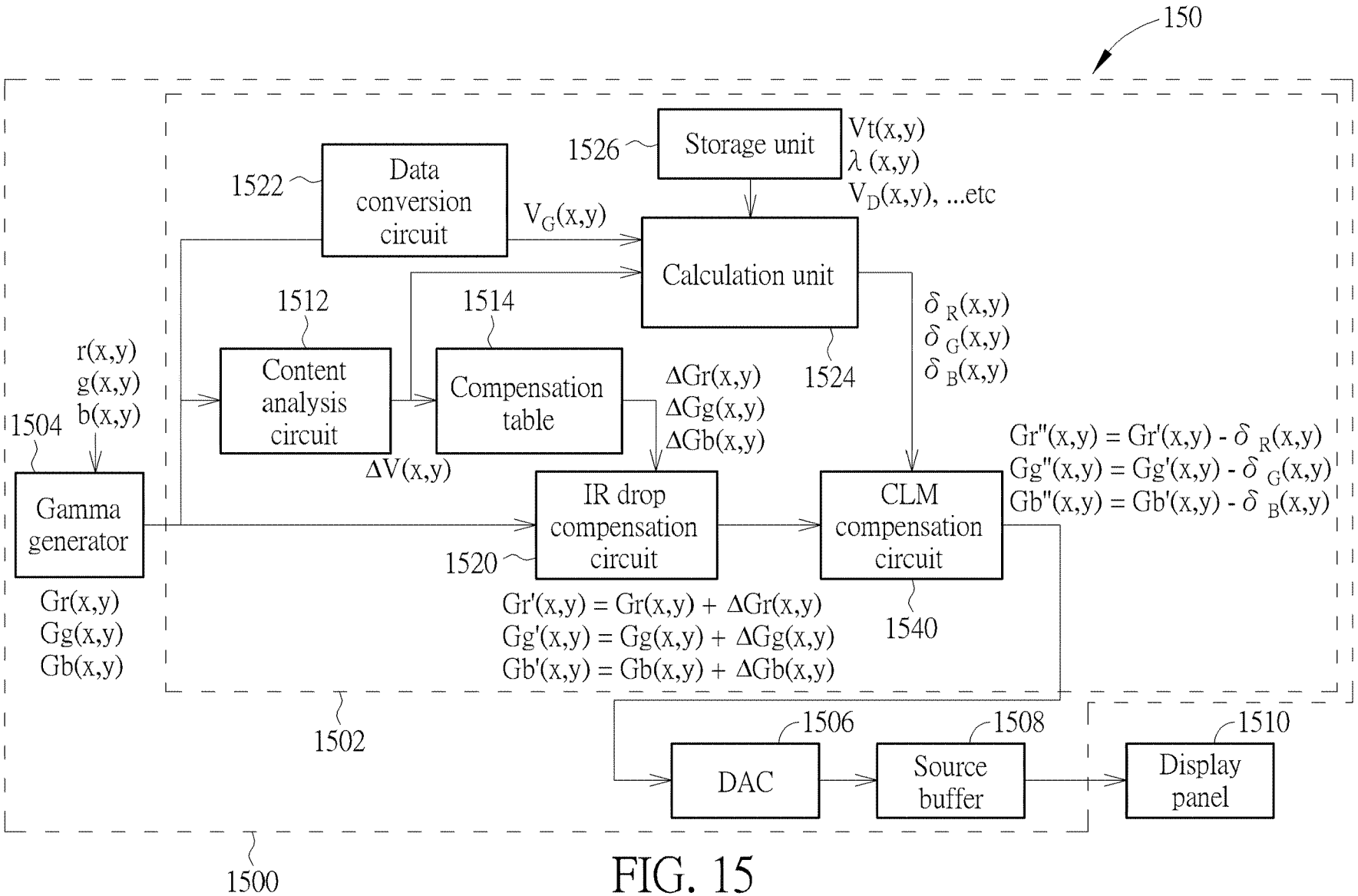
FIG. 15 is a schematic diagram of another display system according to an embodiment of the present invention.

Please note that in the above embodiments, the image compensation circuit and method are implemented in the data domain, to change the image data by compensating for the IR drop and CLM effect. In another embodiment, the image compensation circuit and method may be implemented in the gamma domain. Please refer to FIG. 15, which is a schematic diagram of another display system 150 according to an embodiment of the present invention. As shown in FIG. 15, the display system 150 includes a display driver circuit 1500 and a display panel 1510, where the display driver circuit 1500 includes an image compensation circuit 1502, a gamma generator 1504, a DAC 1506 and a source buffer 1508. The gamma generator 1504 may convert the input image data r(x, y), g(x, y) and b(x, y) into gamma codes (or called gamma data) Gr(x, y), Gg(x, y) and Gb(x, y). The image compensation circuit 1502 thereby compensates the gamma codes Gr(x, y), Gg(x, y) and Gb(x, y) for the IR drop and CLM effect. In detail, the image compensation circuit 1502 may include a content analysis circuit 1512, a compensation table 1514, an IR drop compensation circuit 1520, a data conversion circuit 1522, a calculation unit 1524, a storage unit 1526 and a CLM compensation circuit 1540.

When receiving the gamma codes Gr(x, y), Gg(x, y) and Gb(x, y) from the gamma generator 1502, the content analysis circuit 1512 may analyze the content of the input gamma codes Gr(x, y), Gg(x, y) and Gb(x, y) to obtain the voltage attenuation at each position, and generate the voltage attenuation value ΔV(x, y) of the pixels at different positions. Based on the compensation table 1514, the voltage attenuation value ΔV(x, y) may further be converted into compensation values ΔGr(x, y), ΔGg(x, y) and ΔGb(x, y) at each position, which are added to the input gamma codes Gr(x, y), Gg(x, y) and Gb(x, y), respectively, through the IR drop compensation circuit 1520, in order to generate intermediate gamma codes Gr'(x, y), Gg'(x, y) and Gb'(x, y) as follows:

$$Gr'(x,y)=Gr(x,y)+\Delta Gr(x,y);$$

$$Gg'(x,y)=Gg(x,y)+\Delta Gg(x,y);$$

$$Gb'(x,y)=Gb(x,y)+\Delta Gb(x,y).$$

In addition, the input gamma codes Gr(x, y), Gg(x, y) and Gb(x, y) may also be sent to the data conversion circuit 1522, which converts the input gamma codes into voltage information included in the gate voltage $V_G$(x, y) and send the gate voltage $V_G$(x, y) to the calculation unit 1524. The calculation unit 1524 may also obtain the information of IR drop ΔV(x, y) from the content analysis circuit 1512, and further receive the device characteristics of the pixels (such as the CLM parameter X and the threshold voltage Vt of the TFT and the operation voltage of the OLED represented as the drain voltage $V_D$) from the storage unit 1526, in order to calculate the CLM compensation values $\delta_R$(x, y), $\delta_G$(x, y) and $\delta_B$(x, y). The CLM compensation circuit 1540 thereby incorporates the CLM compensation values $\delta_R$(x, y), $\delta_G$(x, y) and $\delta_B$(x, y) into the intermediate gamma codes Gr'(x, y), Gg'(x, y) and Gb'(x, y) to generate the output gamma codes Gr"(x, y), Gg"(x, y) and Gb"(x, y), as shown below:

$$Gr''(x,y)=Gr'(x,y)+\delta_R(x,y);$$

$$Gg''(x,y)=Gg'(x,y)+\delta_G(x,y);$$

$$Gb''(x,y)=Gb'(x,y)+\delta_B(x,y).$$

Note that in this embodiment, the IR drop compensation values ΔGr(x, y), ΔGg(x, y) and ΔGb(x, y) and the CLM compensation values $\delta_R$(x, y), $\delta_G$(x, y) and $\delta_B$(x, y) are in the gamma code domain.

After the image compensation circuit 1502 performs the compensation to generate the output gamma codes Gr"(x, y), Gg"(x, y) and Gb"(x, y), the output gamma codes may further undergo digital-to-analog conversion, and then be outputted to the display panel 1510 through the source buffer 1508. The detailed operations of the DAC 1506 and the source buffer 1508 are similar to those of the DAC 1406 and the source buffer 1408 as described above, and will not be narrated herein.

Figure 16:
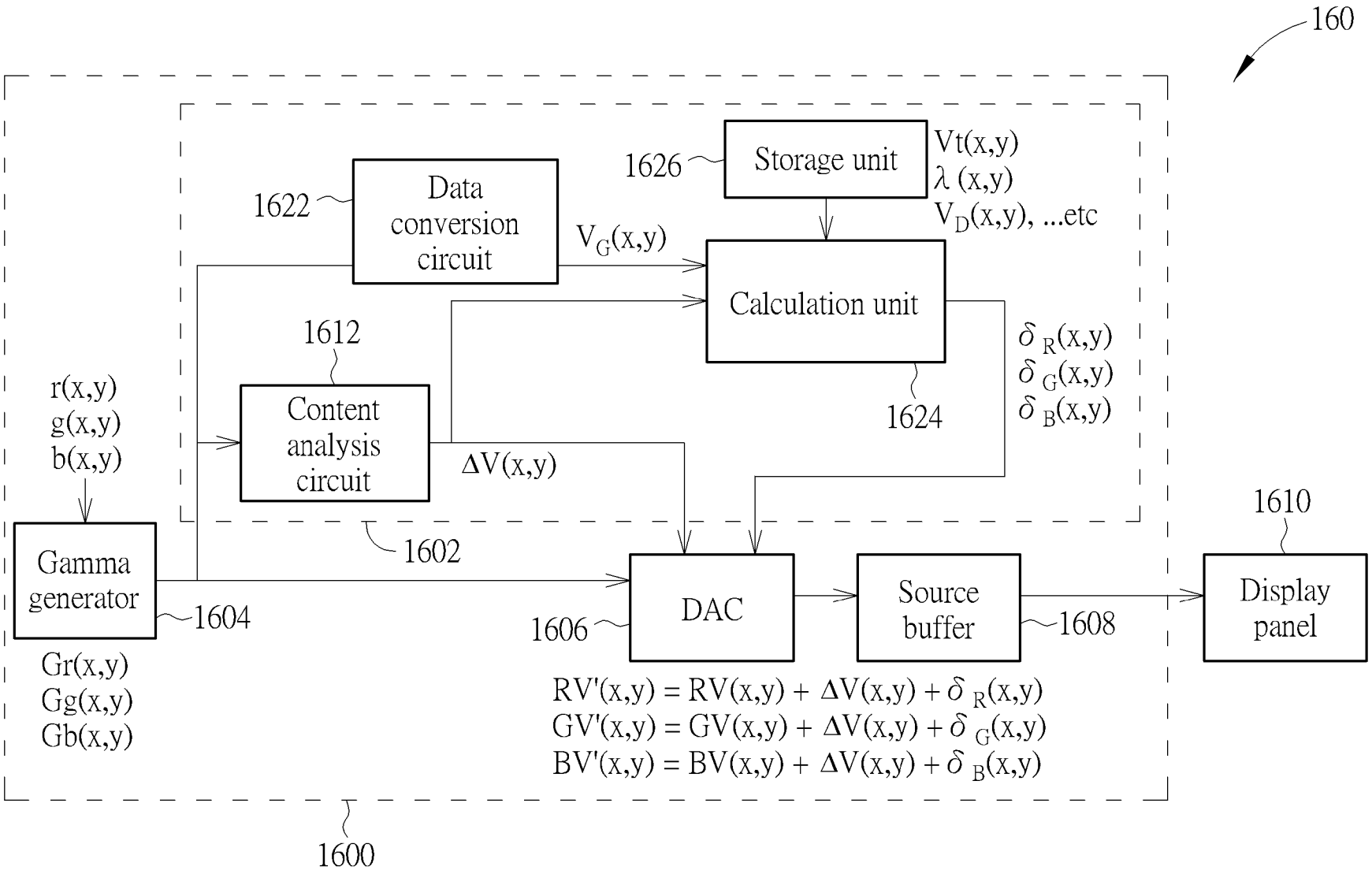
FIG. 16 is a schematic diagram of a further display system according to an embodiment of the present invention.

Please refer to FIG. 16, which is a schematic diagram of a further display system 160 according to an embodiment of the present invention. As shown in FIG. 16, the display system 160 includes a display driver circuit 1600 and a display panel 1610, where the display driver circuit 1600 includes an image compensation circuit 1602, a gamma generator 1604, a DAC 1606 and a source buffer 1608. The detailed operations of the gamma generator 1604, the DAC 1606 and the source buffer 1608 are similar to those of the gamma generator 1404, the DAC 1406 and the source buffer 1408 as described above, and will not be narrated herein. The image compensation circuit 1602 may include a content analysis circuit 1612, a data conversion circuit 1622, a calculation unit 1624 and a storage unit 1626. Similarly, the image compensation circuit 1602 is served to generate the voltage attenuation value ΔV(x, y) for IR drop compensation, and the data conversion circuit 1622, the calculation unit 1624 and the storage unit 1626 are served to generate the compensation values $\delta_R$(x, y), $\delta_G$(x, y) and $\delta_B$(x, y) for CLM compensation. Note that the compensation values $\delta_R$(x, y), $\delta_G$(x, y) and $\delta_B$(x, y) are in the voltage domain.

In this embodiment, the DAC 1606 may generate the gamma voltages RV(x, y), GV(x, y) and BV(x, y) corresponding to the gamma codes Gr(x, y), Gg(x, y) and Gb(x, y) received from the gamma generator 1602. The gamma voltages RV'(x, y), GV'(x, y) and BV'(x, y) actually outputted by the DAC 1606 are modified or shifted from the original gamma voltages RV(x, y), GV(x, y) and BV(x, y) based on the voltage attenuation value ΔV(x, y) and the compensation values $\delta_R$(x, y), $\delta_G$(x, y) and $\delta_B$(x, y) received from the image compensation circuit 1602, as described below:

$$RV'(x,y)=RV(x,y)+\Delta V(x,y)+\delta_R(x,y);$$

$$GV'(x,y)=GV(x,y)+\Delta V(x,y)+\delta_G(x,y);$$

$$BV'(x,y)=BV(x,y)+\Delta V(x,y)+\delta_B(x,y).$$

As a result, the gamma voltages taken by the DAC 1606 may be determined based on not only the received gamma codes Gr(x, y), Gg(x, y) and Gb(x, y), but also the voltage attenuation value ΔV(x, y) corresponding to the IR drop and the compensation values $\delta_R$(x, y), $\delta_G$(x, y) and $\delta_B$(x, y) corresponding to the CLM effect.

Figure 17:
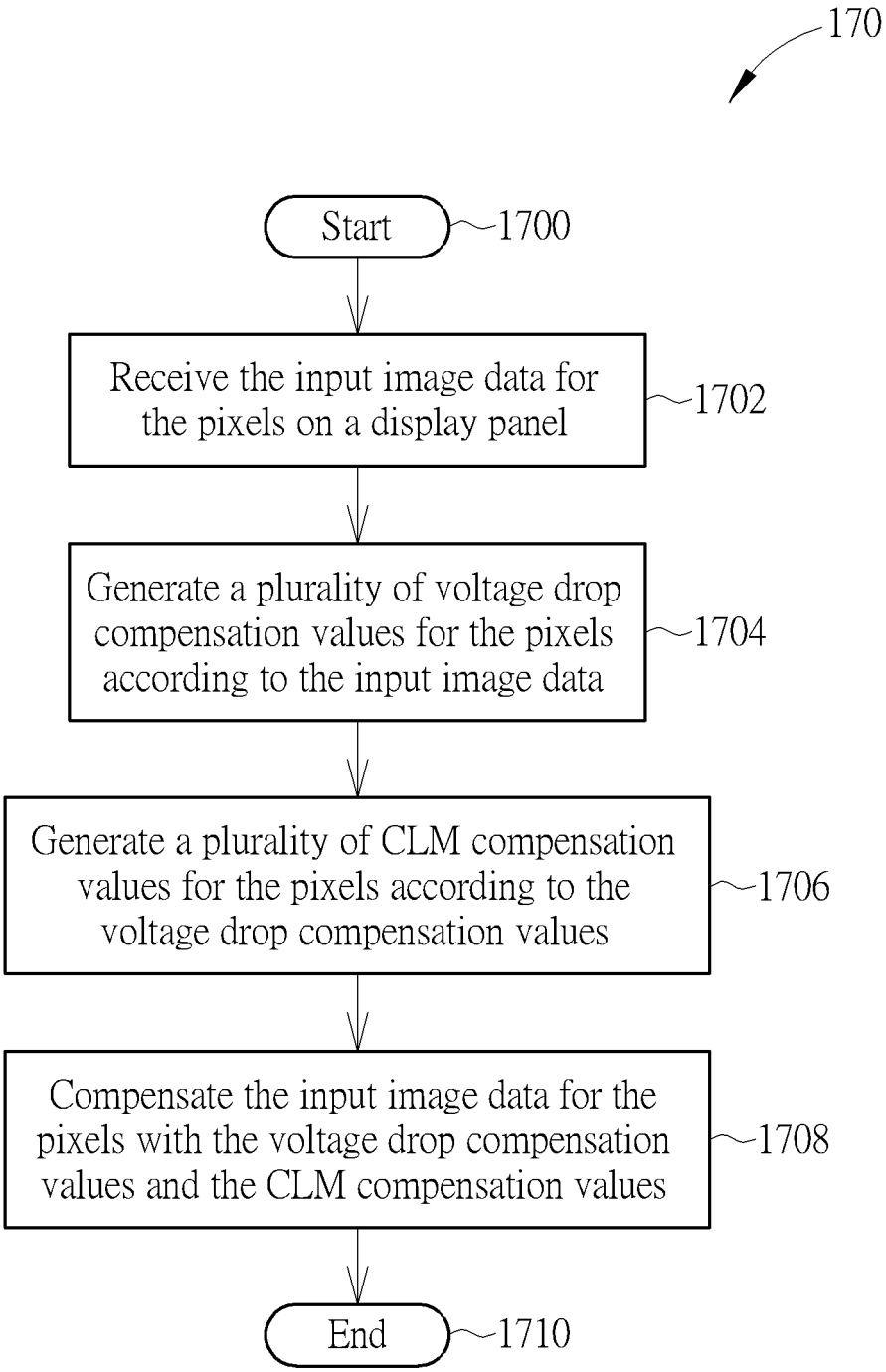
FIG. 17 is a flowchart of an image compensation process according to an embodiment of the present invention.

The abovementioned operations related to image compensation may be summarized into an image compensation process 170, as shown in FIG. 17. The image compensation process 170, which may be implemented in an image compensation circuit of a display driver circuit such as the image compensation circuits 80, 1402, 1502 and 1602 as illustrated above, may include the following steps:

Step 1700: Start.

Step 1702: Receive the input image data for the pixels on a display panel.

Step 1704: Generate a plurality of voltage drop compensation values for the pixels according to the input image data.

Step 1706: Generate a plurality of CLM compensation values for the pixels according to the voltage drop compensation values.

Step 1708: Compensate the input image data for the pixels with the voltage drop compensation values and the CLM compensation values.

Step 1710: End.

The detailed operations and alterations of the image compensation process 170 are illustrated in the above paragraphs, and will not be repeated herein.

To sum up, the present invention provides an image compensation circuit and method to compensate for the IR drop and CLM effect on pixels of the display panel. Different from other compensation methods such as the general IR drop compensation or the Demura compensation where the CLM effect is not considered, the present invention adds the information of CLM effect to the compensation scheme, wherein the information of IR drop may be combined with the information of device characteristics in the pixels and the input image data to calculate the CLM compensation values. Therefore, a complete compensation effect may be achieved, which leads to a higher consistency in the luminance of the display panel.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image compensation circuit generating output image data to drive a display panel, the display panel comprising a plurality of pixels, the image compensation circuit comprising:

a first control circuit to receive input image data for the pixels and generate a plurality of first compensation values for the pixels according to the input image data;

a first compensation circuit, coupled to the first control circuit, to compensate the input image data for the pixels with the first compensation values;

a second control circuit, coupled to the first control circuit, to receive the first compensation values from the first control circuit and generate a plurality of second compensation values for the pixels according to the first compensation values; and a second compensation circuit, coupled to the second control circuit, to compensate the input image data for the pixels with the second compensation values, to generate the output image data;

wherein the first compensation values correspond to a compensation for a voltage drop on the display panel, and the second compensation values correspond to a compensation for a channel length modulation (CLM) effect of the pixels;

wherein at least one compensation value among the first compensation values and the second compensation values for a first pixel among the plurality of pixels is determined according to the input image data for the first pixel and the input image data for a second pixel among the plurality of pixels.

2. The image compensation circuit of claim 1, wherein the second compensation values are determined according to device characteristics of the pixels.

3. The image compensation circuit of claim 2, wherein each of the pixels comprises a plurality of transistors and a light emitting device, and the device characteristics of the pixels comprise a CLM parameter of the transistors.

4. The image compensation circuit of claim 3, wherein the device characteristics of the pixels further comprise at least one of a threshold voltage of the transistors and an operation voltage of the light emitting device.

5. The image compensation circuit of claim 1, wherein the second compensation values for the pixels are different when the input image data for the pixels are the same and the pixels have different colors.

6. The image compensation circuit of claim 1, wherein the second compensation values for the pixels are different when the input image data for the pixels are different.

7. The image compensation circuit of claim 1, wherein the second compensation values for the pixels at different locations of the display panel are different when the input image data for the pixels are the same.

8. The image compensation circuit of claim 1, wherein the second compensation values for the pixels are different when the first compensation values for the pixels are different.

9. A compensation method for an image compensation circuit generating output image data to drive a display panel having a plurality of pixels, the compensation method comprising:

receiving input image data for the pixels;

generating a plurality of first compensation values for the pixels according to the input image data;

generating a plurality of second compensation values for the pixels according to the first compensation values;

compensating the input image data for the pixels with the first compensation values and the second compensation values, to generate the output image data; and determining at least one compensation value among the first compensation values and the second compensation values for a first pixel among the plurality of pixels according to the input image data for the first pixel and the input image data for a second pixel among the plurality of pixels;

wherein the first compensation values correspond to a compensation for a voltage drop on the display panel, and the second compensation values correspond to a compensation for a channel length modulation (CLM) effect of the pixels.

10. The compensation method of claim 9, further comprising:

determining the second compensation values according to device characteristics of the pixels.

11. The compensation method of claim 10, wherein each of the pixels comprises a plurality of transistors and a light emitting device, and the device characteristics of the pixels comprise a CLM parameter of the transistors.

12. The compensation method of claim 11, wherein the device characteristics of the pixels further comprise at least one of a threshold voltage of the transistors and an operation voltage of the light emitting device.

13. The compensation method of claim 9, wherein the second compensation values for the pixels are different when the input image data for the pixels are the same and the pixels have different colors.

14. The compensation method of claim 9, wherein the second compensation values for the pixels are different when the input image data for the pixels are different.

15. The compensation method of claim 9, wherein the second compensation values for the pixels at different locations of the display panel are different when the input image data for the pixels are the same.

16. The compensation method of claim 9, wherein the second compensation values for the pixels are different when the first compensation values for the pixels are different.

* * * * *